US011655695B2

(12) United States Patent
Shields

(10) Patent No.: US 11,655,695 B2
(45) Date of Patent: May 23, 2023

(54) RODLESS PUMP AND MULTI-SEALING HYDRAULIC SUB ARTIFICIAL LIFT SYSTEM

(71) Applicant: Digital Downhole, Inc., Houston, TX (US)

(72) Inventor: Austin J Shields, Houston, TX (US)

(73) Assignee: Digital Downhole Inc., Houston, TX (US)

( * ) Notice: Subject to any disclaimer, the term of this patent is extended or adjusted under 35 U.S.C. 154(b) by 217 days.

(21) Appl. No.: 16/925,479

(22) Filed: Jul. 10, 2020

(65) Prior Publication Data

US 2022/0010661 A1 Jan. 13, 2022

(51) Int. Cl.

| | |
|---|---|
| ***E21B 43/12*** | (2006.01) |
| ***F04B 47/04*** | (2006.01) |
| ***F04B 53/12*** | (2006.01) |
| ***F04B 53/14*** | (2006.01) |
| ***F04B 7/02*** | (2006.01) |

(52) U.S. Cl.

CPC ..... *E21B 43/129* (2013.01); *F04B 7/02* (2013.01); *F04B 47/04* (2013.01); *F04B 53/12* (2013.01); *F04B 53/14* (2013.01)

(58) Field of Classification Search

CPC ..... E21B 43/129; F04B 7/02; F04B 47/04; F04B 53/12; F04B 53/14

USPC ..... 417/555.2

See application file for complete search history.

(56) References Cited

U.S. PATENT DOCUMENTS

| | | | | |
|---|---|---|---|---|
| 2,628,565 A | | 2/1953 | Richardson | |
| 3,849,030 A | * | 11/1974 | McArthur | F01L 21/04 417/393 |
| 3,922,116 A | * | 11/1975 | Pugh | F01L 21/04 91/352 |
| 4,383,803 A | * | 5/1983 | Reese | F04B 47/04 417/264 |
| 4,386,888 A | * | 6/1983 | Verley | F01L 25/063 417/393 |
| 4,405,291 A | * | 9/1983 | Canalizo | E21B 43/121 417/393 |

(Continued)

FOREIGN PATENT DOCUMENTS

| | | |
|---|---|---|
| WO | WO2007140436 A2 | 6/2007 |
| WO | WO2015030931 A2 | 3/2015 |

*Primary Examiner* — Charles G Freay

(74) *Attorney, Agent, or Firm* — Fletcher Yoder PC

(57) ABSTRACT

Oil and gas companies worldwide strive to improve artificial lift efficiencies to minimize environmental footprint and lower operational expense. In order to lower artificial lift costs, the traditional rod pump must be replaced and improved upon. The present invention of the rodless pump and multi-sealing hydraulic sub is an optimized hydraulic pumping system that eliminates rod wear, lowers pump intake pressure, and extends the reserve life of oil and gas wells regardless of casing configuration or depth. Lowering the pump's intake pressure in an oil and gas well by using a positive displacement pump such as the present invention will allow maximum hydrocarbon reserves to be produced with minimal energy consumption to power the pump. The superior surface seals and smaller footprint of the rodless pump eliminate the possibility of surface hydrocarbon leaks, minimizing environmental impact.

19 Claims, 33 Drawing Sheets

(56) References Cited

U.S. PATENT DOCUMENTS

| | | | | | |
|---|---|---|---|---|---|
| 4,478,560 | A | * | 10/1984 | Rupp | F01L 23/00 417/393 |
| 4,611,974 | A | | 9/1986 | Holland | |
| 4,778,355 | A | | 10/1988 | Holland | |
| 4,861,239 | A | | 8/1989 | Simmons | |
| 5,188,517 | A | * | 2/1993 | Koster | F04B 47/08 417/393 |
| 5,873,411 | A | | 2/1999 | Prentiss | |
| 6,082,452 | A | * | 7/2000 | Shaw | E21B 34/06 166/313 |
| 6,155,803 | A | | 12/2000 | Curington | |
| 6,435,843 | B1 | * | 8/2002 | Hur | F04B 9/113 417/399 |
| 6,817,409 | B2 | | 11/2004 | Howard | |
| 7,124,819 | B2 | | 10/2006 | Ciglenee | |
| 2005/0249613 | A1 | | 11/2005 | Jordan | |
| 2006/0008364 | A1 | | 1/2006 | Traylor | |
| 2008/0025857 | A1 | | 1/2008 | Hurst | |
| 2010/0116508 | A1 | | 5/2010 | Oglesby | |
| 2014/0079560 | A1 | | 3/2014 | Hodges | |
| 2014/0294603 | A1 | | 10/2014 | Best | |

* cited by examiner

RODLESS PUMP AND MULTI-SEALING HYDRAULIC SUB ARTIFICIAL LIFT SYSTEM

BACKGROUND

Many oil wells are produced using rod pumps. FIG. 1 depicts a rod pump artificial lift system, and FIG. 2 depicts the pump action of positive displacement rod pumps. The rod pump artificial lift system includes a surface unit 1000 that drives a rod string 1001, located inside the well's production tubing 1002, up and down to actuate a positive displacement pump 1003. Positive displacement pump 1003 may include both a traveling valve 2000 and a standing valve 2001. The production tubing may be run inside production casing 1006 or in an open hole, uncased well.

Traveling valves are one-way check valves that move position as the valve opens and closes. Standing valves are one-way check valves that are stationary as the valve opens and closes. All existing rod pumps must have the traveling valve 2000 above the standing valve 2001 due to the need to match the traveling valve's positions with the up and down movement of the rod string 1001. The inability to have a standing valve above the traveling valve, due to the rod string being in the way, can allow solids in the well's production tubing to be pulled by gravity down into the plunger/barrel seal, fouling the pump. On the upstroke 2100 the traveling valve is seated, lifting fluid to surface and the standing valve is open, allowing the well's produced fluid to enter the pump's production chamber 2003. On the downstroke 2200, the standing valve closes, while the traveling valve is open, filling the pump plunger 2004 with the fluid previously sucked into the pump's production chamber.

Rod pumps work satisfactorily in some vertical well applications. Less hole deviation correlates with lower levels of rod wear from friction caused by the rods rubbing against the production tubing strings. However, no well is perfectly vertical due to drilling error and rock variations, meaning that operating costs still can be lowered with a pump that is unaffected by rod wear. In a rod pump well, the well's tubing pressure is contained at surface by a stuffing box seal above the wellhead 1005, and if this seal is worn or broken, oil can leak and contaminate the well's surrounding environment.

Horizontal or deviated wells have additional challenges relative to vertical or slightly deviated wells: high gas to oil ratios, surging and slug flow with multiple fluid phases, and long sideways drilling paths (step outs) above the kick off point 1004 have made rod pumps ineffective and unsuitable for these applications. The kickoff point 1004 is the point at which the well starts to turns horizontal. The portion of the well where it turns horizontal is referred to as the curve of the well 1007. FIG. 3 depicts a rod pump artificial lift setup and the pump traversing the curve of the well. Traditional rod pumps are not suitable to traverse through the curve of a well. FIG. 3A depicts a close-up view of the continuous bend put on the rods 1001, causing them to contact the tubing 1002 with a side force that damages both the rods and the tubing. The added costs from intermittently repairing these damages may mean that rod pumps cannot be cost effectively operated in a desirable location below the kick off point. It may be desirable to operate the pump lower in the well because the fluid above the pump can be pumped to surface. A lower pump setting depth reduces the hydrostatic pressure on the reservoir, lowers the intake pressure at the pump, and allows more hydrocarbons to be produced from the well.

Hydraulically powered, positive displacement pumps are an alternative to rod pumps. However, due to a number of disadvantages of existing designs, they rarely are the best solution for artificial lift and represent a small proportion of the artificial lift market share. Hydraulic pumping systems transmit power downhole by using power fluid pressurized at surface to drive a reciprocating piston pump located downhole disposed near the bottom of production tubing string. Hydraulic pumps of prior design returned the power fluid to surface mixed with the well's produced fluids (oil, gas, water). Separation of the power fluid and produced fluids is necessary for reuse of the power fluid and sale of the produced hydrocarbon fluids.

FIG. 4 depicts the surface apparatus of a conventional hydraulic pump setup. Hydraulic pump systems of prior design consisted of a reservoir vessel 4000 containing the cleaned power fluid 4001, a surface pump to pressurize the power fluid 4002 and pump it down the wellhead 4003, production tubing 4003A to transmit the power fluid to actuate the downhole hydraulic reciprocating piston pump, and a surface separation system 4004 designed to receive the commingled return mixture 4005 of reservoir fluids and power fluid and separate the mixture into individual flow streams of power fluid and produced fluid 4006 and gas 4007. Solids are commonly removed from the power fluid stream via a cyclonic separator 4008, filter, or similar apparatus before returning the cleaned power fluid 4001 to the reservoir vessel 4000. The produced fluids may further be separated out into oil 4009, gas 4011, and water 4010 streams via another separator.

FIG. 5 shows the downstroke and FIG. 6 shows the upstroke of a double acting hydraulic pump of common use. After the power fluid is pumped down the tubing, the power fluid 5000 enters the pump's power fluid intake. The power fluid drives an engine piston 5001 from either side of the piston. The power fluid is then expelled from the pump via the engine piston power fluid exhaust port 5002 for return to surface. The engine piston is connected to a pump piston 5003 that interacts with the produced fluid from the well 5004. The produced fluids are expelled from the produced fluids pump exhaust 5005 for return to the surface. The engine piston may only interact with the power fluid, and the production piston may only interact with produced fluids. The power fluids and production fluids are mixed after being expelled from the pump and flow up a common conduit to surface; the mixed fluid at surface must then be separated in order to recycle the power fluid and send the produced fluids to production facilities using a process similar to FIG. 4. In the double acting design, there are a number of small and intricate power fluid flow paths necessary to cycle the piston between the up and down strokes when pumping power fluid unidirectionally into a single-entry point into the pump. These intricate power fluid flow paths limit the stroke length of the pump due to design difficulty, expense, and flow friction associated with long, narrow power fluid flow paths. Simplification of the flow paths of the power fluid and produced fluid is highly desirable to extend pump life, reduce cost, and increase efficiency of pumping operations.

In existing hydraulic pump designs, there are no sealing elements directly between the power fluid chambers and the interior surface of the production tubing or interior surfaces of any subassemblies disposed on the production tubing. There is also no set of independent hydraulic connections to drive an upstroke and downstroke. The power fluid enters the pump in a singular direction, ratchets the pump piston between upstroke and downstroke, is contained within the pump as it actuates the pistons to do work, is expelled from the pump, and returns to surface commingled with the production fluid. The lack of multiple, independent power fluid chambers and the associated power fluid chamber seals is a defining feature of existing hydraulic pump design and greatly limits their use.

Hydraulically driven piston pumps of prior design may preferably be set near the bottom of a production tubing string in an oil and gas well. FIG. 7 illustrates an example of a retrievable hydraulic pump setup. Power fluid 7000 is pressurized at surface and pumped down the production tubing 7001 until it reaches the pump 7002. Hydraulic pump 7002 corresponds to the external visualization of a hydraulic pump similar in nature to the one outlined in FIG. 5 and FIG. 6. The power fluid enters the pump and mixes with produced fluid 7003, exits the pump as commingled fluid 7004 and flows up the annulus between the tubing and the casing 7005. The power fluid flows through the pump via a top intake connected to the production tubing. There are no seals directly between the exterior of the pump and the interior of the tubing that allow power fluid to be pumped directly or independently into the piston's engine chambers. The power fluid must flow down the production tubing to enter the pump. The power fluid then exits the pump and is commingled with the produced fluids. The power fluid also flows unidirectionally. There are a number of arrangements in which the power fluid flows in a singular direction down a conduit and then actuates a hydraulic piston pump.

U.S. Pat. No. 4,861,239 mentions a dual power tube configuration for the resetting of a power piston that is driving a production piston with power piston and production piston connected by a solid rod, where one piston that only interacts with power fluid is connected to another piston that only interacts with produced fluid. This functional setup is a less efficient version of the analogous and commonly used hydraulic pump described in FIGS. 5 and 7. Similarly, U.S. Pre-Grant Publication 2005/0249613 describes a black box type hydraulic pump that utilizes multiple power fluid lines to actuate a downhole piston. The multiple power tube pump described in U.S. Pat. No. 4,861,239 (FIG. 17) has no fewer than 18 check valves, while the black box pump described in US2005/0249613 (FIG. 1) has 6 check valves. As a result, these prior art systems are ineffective at pumping, extremely complicated, and prohibitively costly to install, maintain, and service; these factors likely explain why pumps according to these designs are not in widespread commercial use today.

SUMMARY

Both of the above-mentioned prior art publications lack (1) a landing receptacle for the downhole pumps along with any description of mating seal arrangement between the interior of the landing receptacle for the pumps and the exterior of the pumps to couple a first hydraulic line to a first working chamber and a second hydraulic line to a second working chamber, respectively (2) two working pistons, not necessarily of the same diameter, connected via a connecting rod that seals on the exterior of the rod to provide pressure isolation between two, independent working fluid chambers with hydraulic connections to the upstroke and downstroke lines located on either side of the seal, and (3) a flow path comprising one or more check valves wherein an inner through-bore, hydraulically connected to a traveling valve and standing valve through the pumps' pistons, actuated by fluid pressure changes that cause reciprocation, permitting wellbore fluid to be pumped to the surface. The combination of these features in the rodless pump disclosed herein may allow the ability to run concentric power fluid strings and the production tubing string sequentially. This design can simplify pump installation and allow for the retrieval and servicing of the rodless pump disclosed herein without the added cost and expense of retrieving three or more concentric strings of tubing. The rodless pump disclosed herein may be removed via slickline or by removing only a single tubing string depending on configuration. Even when the power fluid strings are run non-concentrically and exterior to the production tubing, the prior art designs do not allow removal of the pumps from the well independently from the power fluid strings. The rodless pump described herein may have only two valves: a traveling valve and a standing valve. This can allow for efficient actuation of a simple positive displacement pump and a minimal number of failure points.

The rodless pump described herein can include a connecting rod with an exterior seal or seals that allow for differently sized piston areas (and associated working chambers of different diameters) to be exposed to the power fluid in the upstroke and downstroke chamber, respectively. This configuration can reduce the power at surface necessary to actuate the pump by allowing differences between the pump's intake pressure (the well's bottom hole pressure) and output pressure (the well's production tubing pressure) of the produced fluids to be balanced out by the differently sized areas exposed to the power fluid, minimizing the force necessary to reciprocate the working pistons.

A downhole hydraulic pump can include a first working piston having a first surface in contact with a power fluid and a second surface in contact with a wellbore fluid, a second working piston having a first surface in contact with a power fluid and a second surface in contact with a wellbore fluid, and a connecting rod coupling the first working piston to the second piston. A first working chamber may be defined at least in part by the first surface of the first working piston, and a second working chamber may be defined at least in part by the first surface of the second working piston. The downhole hydraulic pump may further include a seal arrangement respectively coupling a first hydraulic line to the first working chamber and a second hydraulic line to the second working chamber, wherein pressure applied via at least one of the first hydraulic line and the second hydraulic line causes reciprocation of the working pistons. The downhole hydraulic pump can further include a flow path comprising one or more check valves, wherein the one or more check valves may be actuated by fluid pressure changes caused by reciprocation of the working pistons, thereby permitting wellbore fluid to be pumped to the surface. The flow path may be disposed within the connecting rod.

Pressure may be alternately applied via the first hydraulic line and the second hydraulic line to cause reciprocation of the working pistons. The seal arrangement may be a hydraulic sub. The first working chamber and second chamber may be pressure isolated from one another by seals disposed about the connecting rod. The downhole hydraulic pump may further include an external structure allowing surface equipment to latch onto and retrieve the pump without removing a production fluid string or the first and second hydraulic lines from a well. The external structure may be a fishing neck. The pump may be mechanically affixed to the production tubing such that retrieving the pump requires removing at least a portion of a production fluid string from a well. Retrieving the pump may further require removing at least a portion of one or both of the first and second hydraulic lines from the well.

The first and second hydraulic lines may be independent from an annulus of the wellbore. The first hydraulic line, second hydraulic line, and the production tubing may be non-coaxial. At least one of the first and second hydraulic lines may be concentric with and exterior to a production string. Both the first and second hydraulic lines may be concentric with and exterior to the production string. One of the first or second hydraulic lines may be defined at least in part by a casing of the well. The first hydraulic line, second hydraulic line, and the production tubing may be non-coaxial. At least one of the first and second hydraulic lines may be concentric with and exterior to a production string. Both the first and second hydraulic lines may be concentric with and exterior to the production string.

A method of pumping fluid from a wellbore can include delivering working fluid to a first working chamber of a downhole hydraulic pump. The first working chamber may be defined at least in part by a first working piston. Delivering working fluid to the first working chamber may actuate a piston assembly of the pump comprising the first working piston in a first direction. The method can further include delivering working fluid to a second working chamber of the downhole hydraulic pump. The second working chamber may be defined at least in part by a second working piston. Delivering working fluid to the second working chamber may actuate the piston assembly of the pump, which further includes the second working piston, in a second direction opposite the first direction. The piston assembly may further include a connecting rod coupling the first working piston and the second working piston. Reciprocation of the piston assembly may one or more check valves, thereby permitting wellbore fluid to be pumped to the surface. Wellbore fluid may be pumped to the surface through a flow path disposed within the connecting rod. The method can further include alternately delivering working fluid to the first working chamber and delivering working fluid to the second working chamber via a first hydraulic line and a second hydraulic line. The first working chamber and second working chamber may be pressure isolated from one another by seals disposed about the connecting rod.

A downhole hydraulic pump can include a piston assembly having first and second pistons coupled by a connecting rod. The first piston may at least partially define a first working chamber, and the second piston may at least partially define a second working chamber. The downhole hydraulic pump can further include means for causing reciprocal action of the piston assembly by alternating application of hydraulic fluid pressure from the surface to the first and second working chambers. The downhole hydraulic pump may still further include a production fluid flow path that passes through the piston assembly and further includes at least one check valve actuatable by wellbore fluid pressure changes induced by reciprocation of the piston assembly.

BRIEF DESCRIPTION OF THE DRAWINGS

FIGS. 12A-12D depict the fluid flow through rig-less rodless pump landed in an open annulus hydraulic sub with independent power fluid strings.

FIGS. 14A-14D depict the fluid flow through a rodless pump landed in an open annulus hydraulic sub.

FIG. 15HS depicts a hydraulic sub receptacle for a tubing retrievable pump run in a closed annulus system run above a packer to isolate the downhole fluids below.

DETAILED DESCRIPTION

Figure 1:
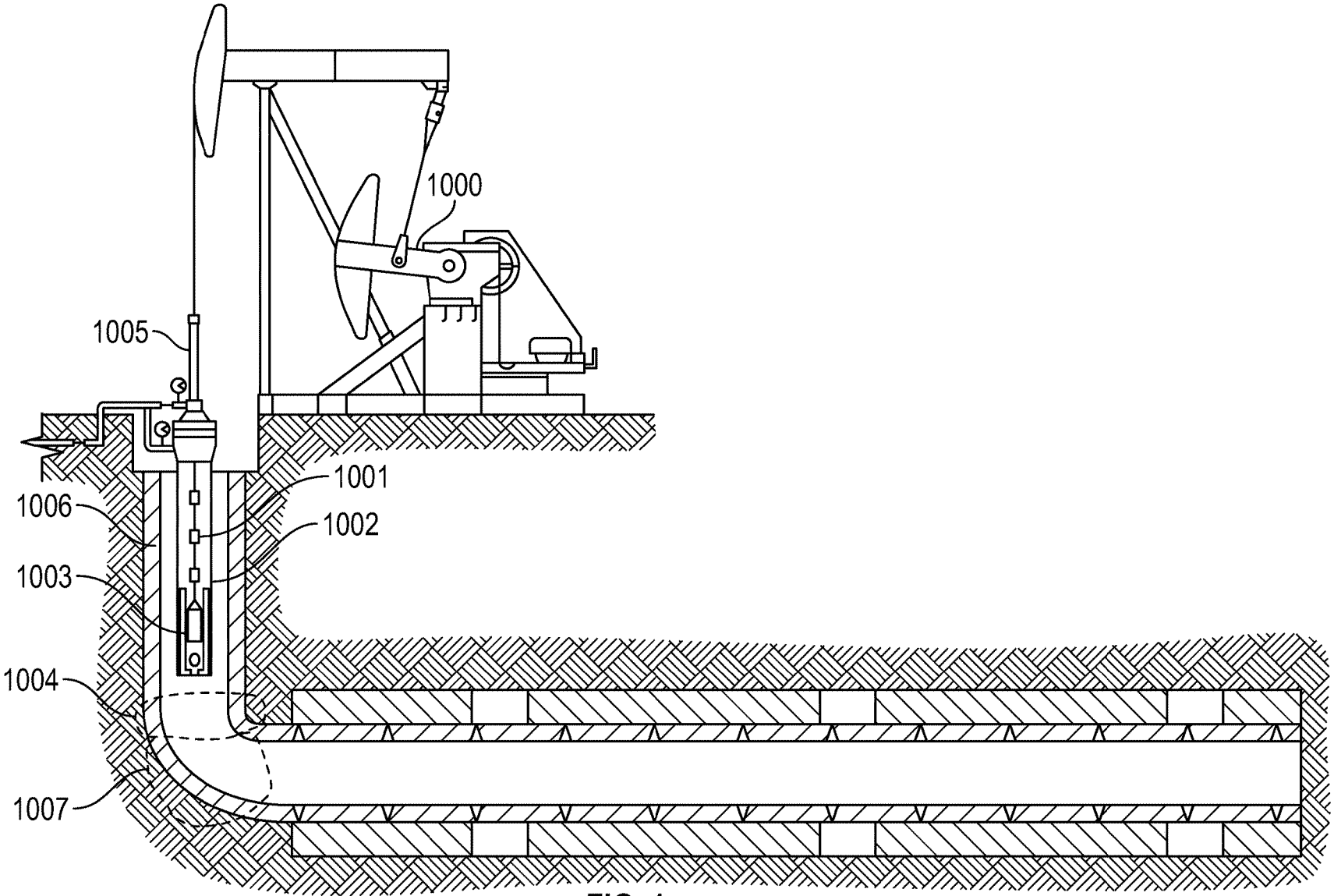
FIG. 1 depicts a rod pump artificial lift system.
Figure 2:
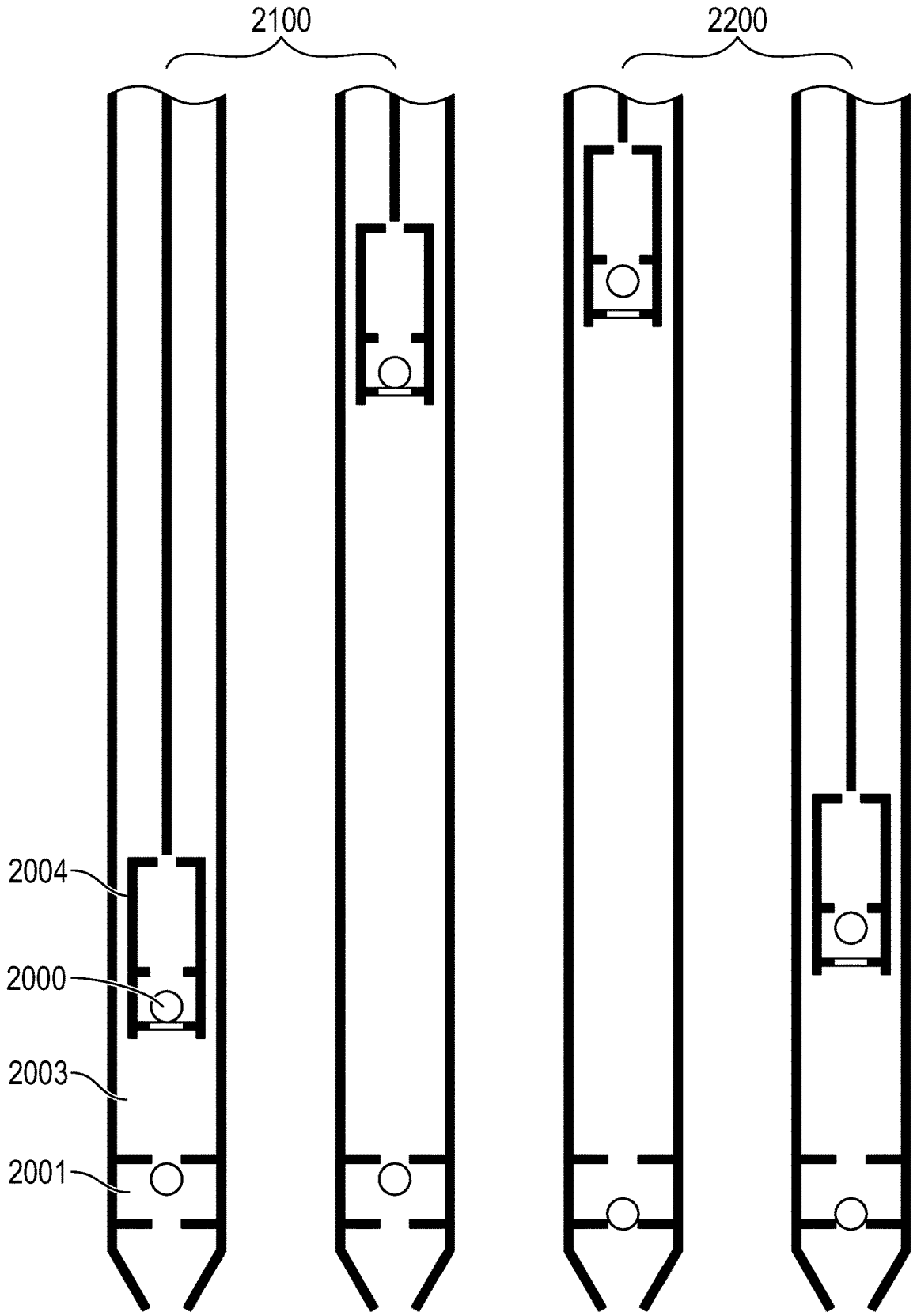
FIG. 2 depicts the pump action of positive displacement rod pumps.
Figure 3:
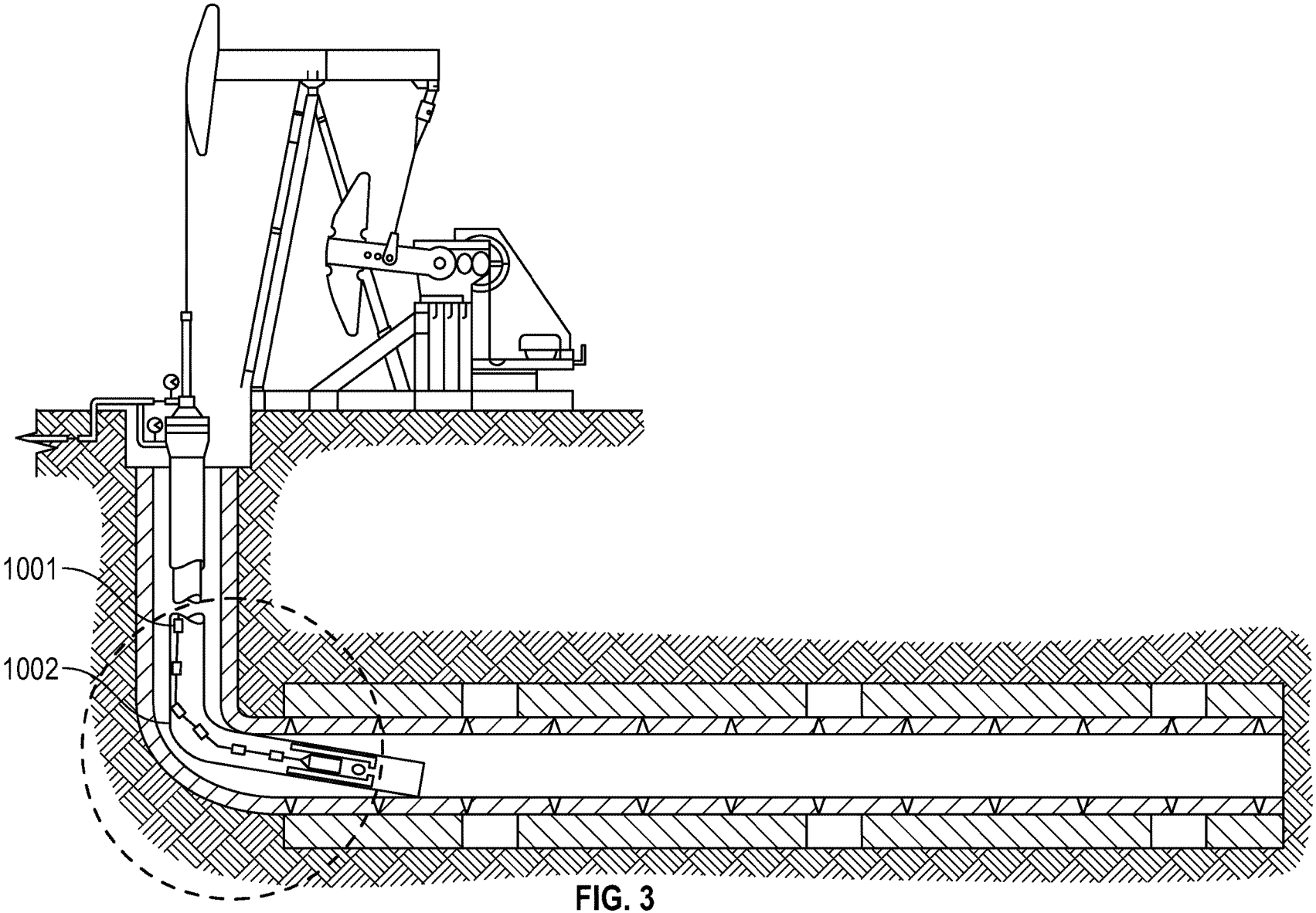
FIGS. 3 and 3A depict a rod pump artificial lift setup and a pump traversing the curve of the well.
Figure 3A:
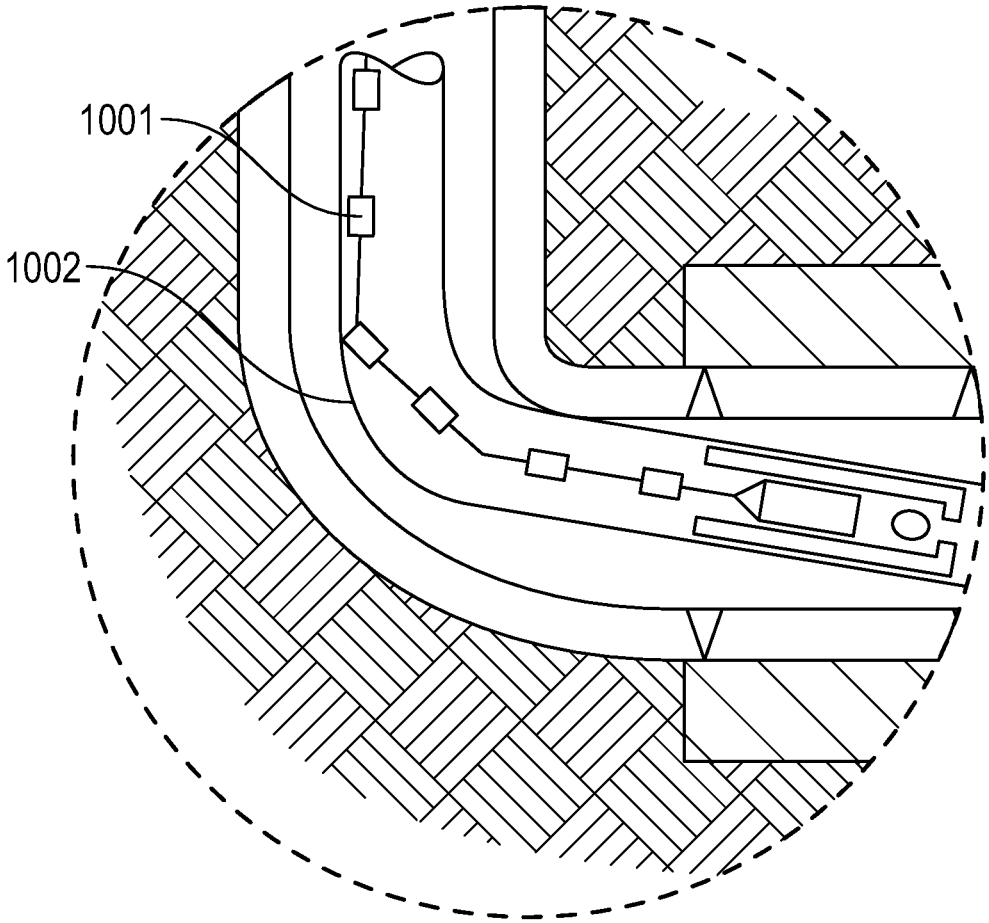
Figure 4:
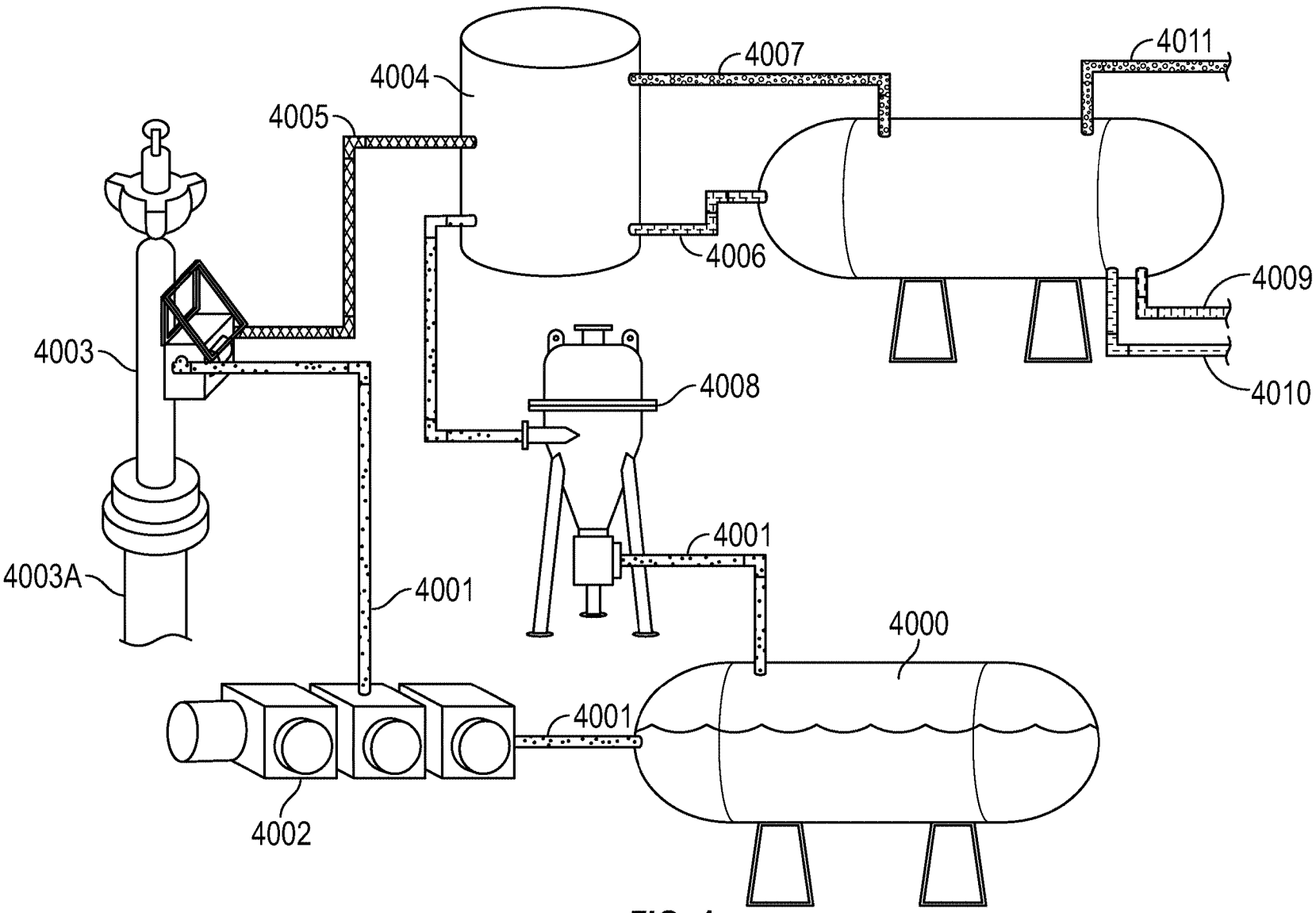
FIG. 4 depicts the surface apparatus of a conventional hydraulic pump setup.
Figure 5:
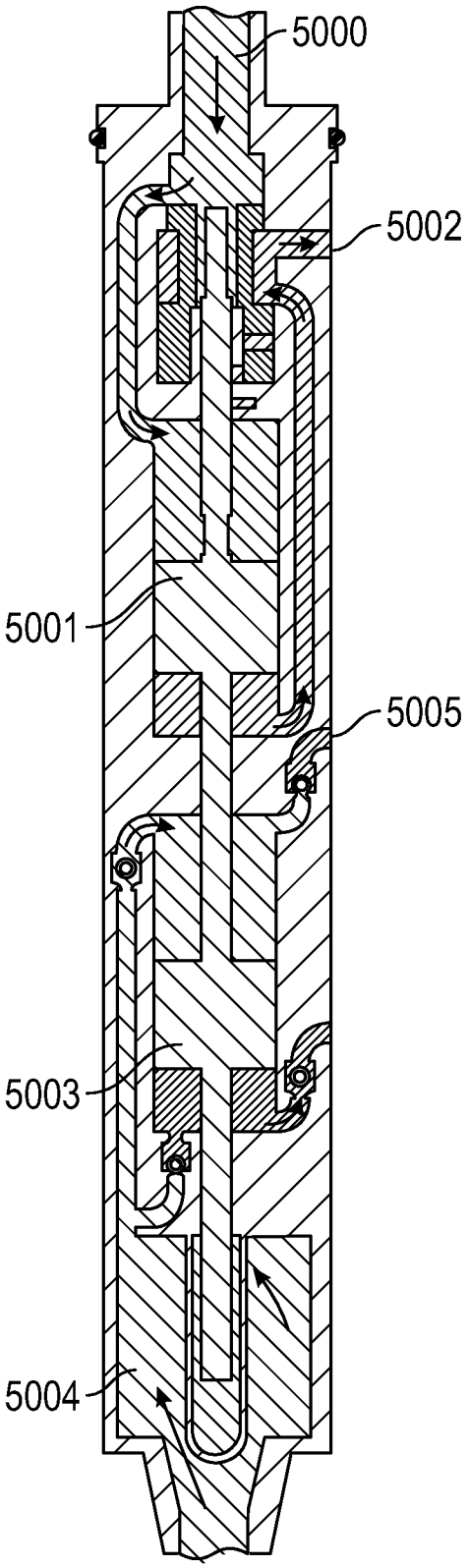
FIG. 5 shows the downstroke of a double acting hydraulic pump.
Figure 6:
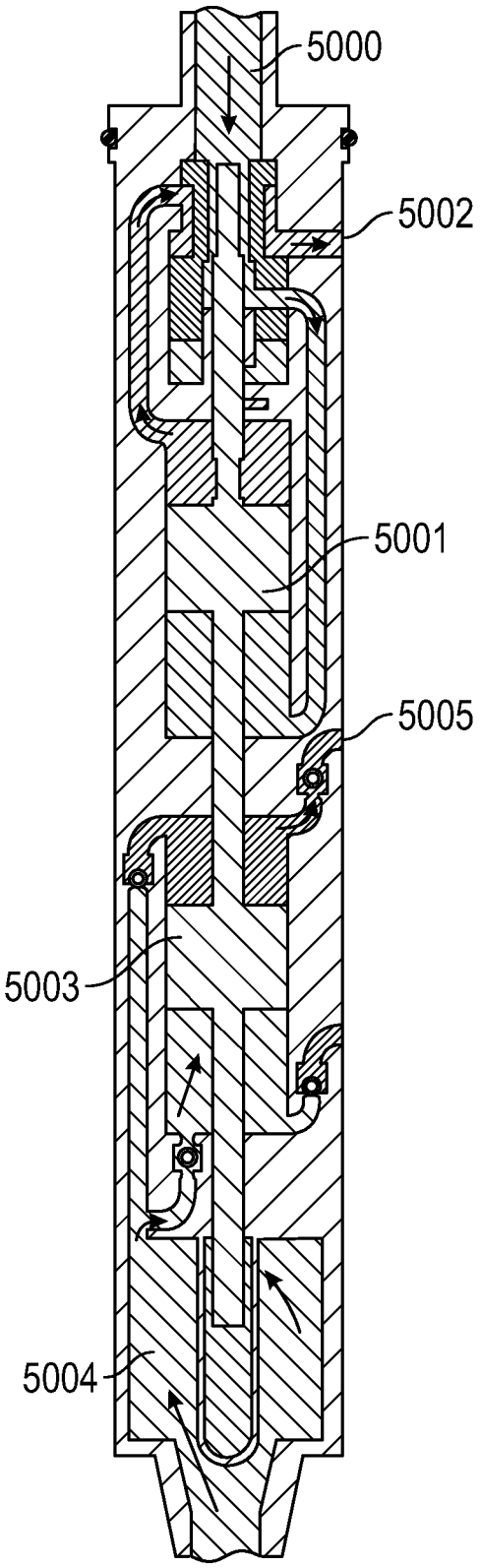
FIG. 6 shows the upstroke of a double acting hydraulic pump.
Figure 7:
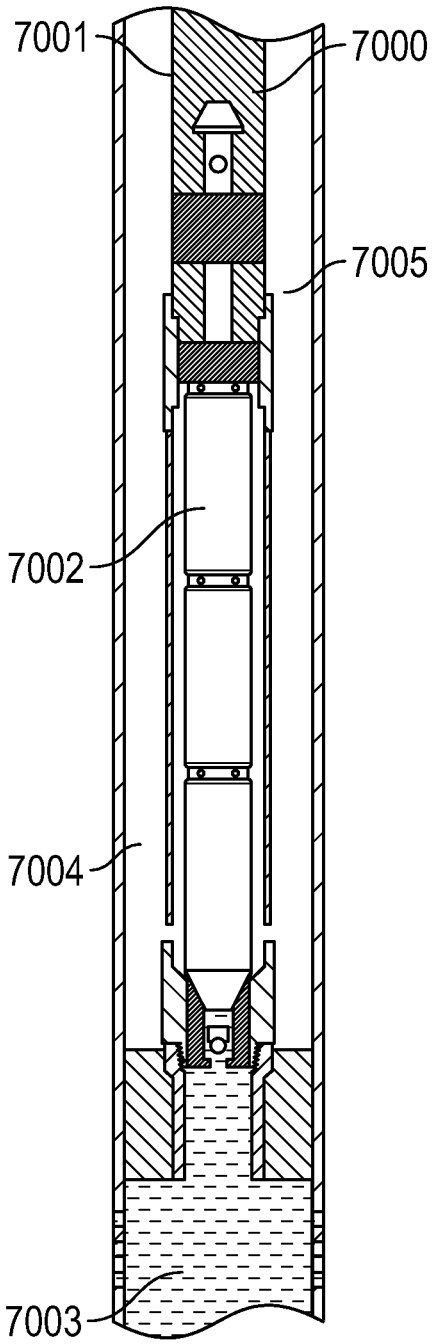
FIG. 7 illustrates an exemplary retrievable hydraulic pump setup.

In the following description, for purposes of explanation, numerous specific details are set forth to provide a thorough understanding of the disclosed concepts. As part of this description, some of this disclosure's drawings represent structures and devices in block diagram form for sake of simplicity. In the interest of clarity, not all features of an actual implementation are described in this disclosure. Moreover, the language used in this disclosure has been selected for readability and instructional purposes, has not been selected to delineate or circumscribe the disclosed subject matter. Rather the appended claims are intended for such purpose.

Various embodiments of the disclosed concepts are illustrated by way of example and not by way of limitation in the accompanying drawings in which like references indicate similar elements. For simplicity and clarity of illustration, where appropriate, reference numerals have been repeated among the different figures to indicate corresponding or analogous elements. In addition, numerous specific details are set forth in order to provide a thorough understanding of the implementations described herein. In other instances, methods, procedures and components have not been described in detail so as not to obscure the related relevant function being described. References to "an," "one," or "another" embodiment in this disclosure are not necessarily to the same or different embodiment, and they mean at least one. A given figure may be used to illustrate the features of more than one embodiment, or more than one species of the disclosure, and not all elements in the figure may be required for a given embodiment or species. A reference number, when provided in a given drawing, refers to the same element throughout the several drawings, though it may not be repeated in every drawing. The drawings are not to scale unless otherwise indicated, and the proportions of certain parts may be exaggerated to better illustrate details and features of the present disclosure.

A rodless pump may be a downhole, hydraulic, positive displacement pump that uses multiple power fluid strings run exterior to the production tubing. The production tubing may be an innermost tubing string that transports saleable hydrocarbons to surface. In hydraulic pumps of prior design, the production fluid string was sometimes used as a power fluid flow conduit. Conversely, in at least some embodiments of a rodless pump, the power fluid can actuate the rodless pump system via a separate hydraulic sub that can include a seal arrangement to hydraulically couple a first hydraulic line to the first working chamber (the upstroke chamber) and a second hydraulic line to hydraulically couple to a second working chamber (the downstroke chamber), wherein pressure applied via at least one of the first hydraulic line and the second hydraulic line causes reciprocation of the working pistons. The upstroke chamber may be defined at least in part by the first surface in contact with a power fluid of a first working piston. The downstroke chamber may be defined at least in part by the first surface in contact with a power fluid of a second working piston. The hydraulic sub's seal arrangement may be disposed near the bottom of the production tubing and may allow for transfer of power fluids from conduits external to the pump directly into the pump's upstroke and downstroke power fluid chambers for pump actuation.

The hydraulic sub may serve as a sealing receptacle for the exterior of the pump. Additionally, a retrievable pump may land in the hydraulic sub and seal to isolate the multiple power fluid strings from production fluids. In some embodiments of the hydraulic sub, pump seals disposed against the rodless pump power fluid chambers, bidirectional flow capabilities of the power fluid conduits, and independently sealed power fluid chambers may allow rig-less retrieval of the pump and conservation of power fluids, reducing well production costs.

In at least some embodiments, the rodless pump may be different from existing positive displacement pumps at least in part because its hydraulic drive forces come from the opposite side of a piston exposed to production fluid. These hydraulic drive forces may result from changing pressure applied to the more than one exposed piston areas, causing the pump to change position. This drive mechanism can allow the option of placing the traveling valve below the standing valve, which may, in turn, provide advantages in pump efficiency and gas handling because of a more fully swept pumping chamber. A standing valve placed above the traveling valve may also block solids from falling back in on the seal between the upper working piston and the upper barrel assembly, resulting in superior solids handling and pump life.

In some applications, it may be preferable to run the rodless pump threaded on the bottom of the production tubing. In such a tubing run application, the rodless pump may seal against a hydraulic sub that may disposed on the bottom of a concentric power fluid string.

In at least some embodiments, a rodless pump as described herein may lower power consumption as compared to traditional rod pumps. This reduction in power may be sufficient to allow a rodless pump to be powered by relatively low power renewable sources, such as solar or wind.

Additionally, the rodless pump can eliminate both the surface stuffing box seal of traditional rod pumps and the surface power fluid separation apparatus of traditional hydraulic pumps, reducing the possibility of oil leaks and reducing surface footprint.

The rodless pump may have at least two power fluid lines and two piston areas that an upstroke line pressure and a downstroke line pressure respectively act on. The rodless pump may have a first working piston having a first surface in contact with a power fluid and a second surface in contact with a wellbore fluid. The rodless pump may also have a second working piston having a first surface in contact with a power fluid and a second surface in contact with a wellbore fluid. The pressure of a power fluid in an upstroke line may act on the lower exposed area of an upper working piston. The pressure of the power fluid in a downstroke line may act on an upper exposed area of a lower working piston. Upstroke and downstroke pistons may be mechanically connected via a rod which may be hollow in some embodiments. The pistons themselves may be partially hollow in some embodiments to allow fluid to pass through them as well through the rod. A connecting rod may contact seals positioned between the power fluid chambers, exterior to the rod. These seals isolate the power fluid chambers from pressure communication, enabling a key feature of the rodless pump: the ability to have a differently sized areas exposed to power fluid pressures in the upstroke chamber and downstroke chambers, respectively. In some embodiments, each working piston may have a first surface exposed to power fluid, and a second surface in contact with production fluid. The pistons are moved by a force originating from the opposite side of the power fluid chamber as the production fluid. As a result, solids suspended in the production fluid are less likely to foul the seal between the piston and the barrel due to the clean power fluid lubricating the piston/barrel seal. Areas of the working pistons exposed to the power fluid and density of the multiple power fluid streams may be adjusted to alter the forces acting on the upstroke and downstroke working piston areas. The forces acting on pump can be balanced downhole to minimize required power of the surface power fluid pump as a function of the difference between hydrostatic pressure in the tubing (the pressure acting on the upper area of the upper piston) and the wellbore pump intake pressure (the pressure acting on the bottom area of the lower piston). A through bore can allow passage of production fluid through both pistons, a hollow connecting rod, and a traveling valve affixed to the dual piston and rod setup. An optimal pump and hydraulic sub system design may contain pistons with different areas as dictated by well conditions. The rodless pump and hydraulic sub allow balancing of the forces downhole, at the point where force is applied to lift wellbore fluids. This can eliminate an inefficiency of traditional rod pumps arising from their need to always keep the entire rod string in tension to avoid rod buckling, which by definition results in a pumping system that is not balanced down hole at the pump.

The power fluid may be transferred to the power fluid chambers via two strings run exterior to the production tubing with an open annulus. The power fluid strings may be concentric to each other and/or the production tubing, or they may be non-concentric. A nonconcentric, open annulus setup may include two tubing strings run alongside the production tubing and each power fluid string being hydraulically connected to a different power fluid chamber. A concentric open annulus setup may include three sets of tubing, with the production tubing being run on the innermost string, the first power fluid string disposed around the production tubing, and the second power fluid string disposed around the first power fluid string. A mixed concentric/nonconcentric setup with an open annulus can include one power fluid string disposed around the production tubing and a second nonconcentric power fluid string run exterior to the first power fluid string.

The power fluid may alternatively be transferred to the power fluid chambers via a closed annulus by using a pump set above a casing packer. In some embodiments, a closed annulus setup can have one fewer power fluid string than an open setup by utilizing the annulus above the packer seal and exterior to the first power fluid conduit and/or production tubing as the second power fluid conduit. A nonconcentric, closed annulus setup may include a single power fluid string run alongside the production tubing as the first power fluid string, with the annulus exterior to both the production tubing and the power fluid string acting as the second power fluid string. A concentric closed annulus setup may include the production tubing and a concentric power fluid string disposed around the production tubing as the first power fluid string. The second power fluid flow path in this case may be the annulus sealed at the bottom by the packer, on the interior by the first power fluid string, and on the exterior by the well's casing.

Figure 8:
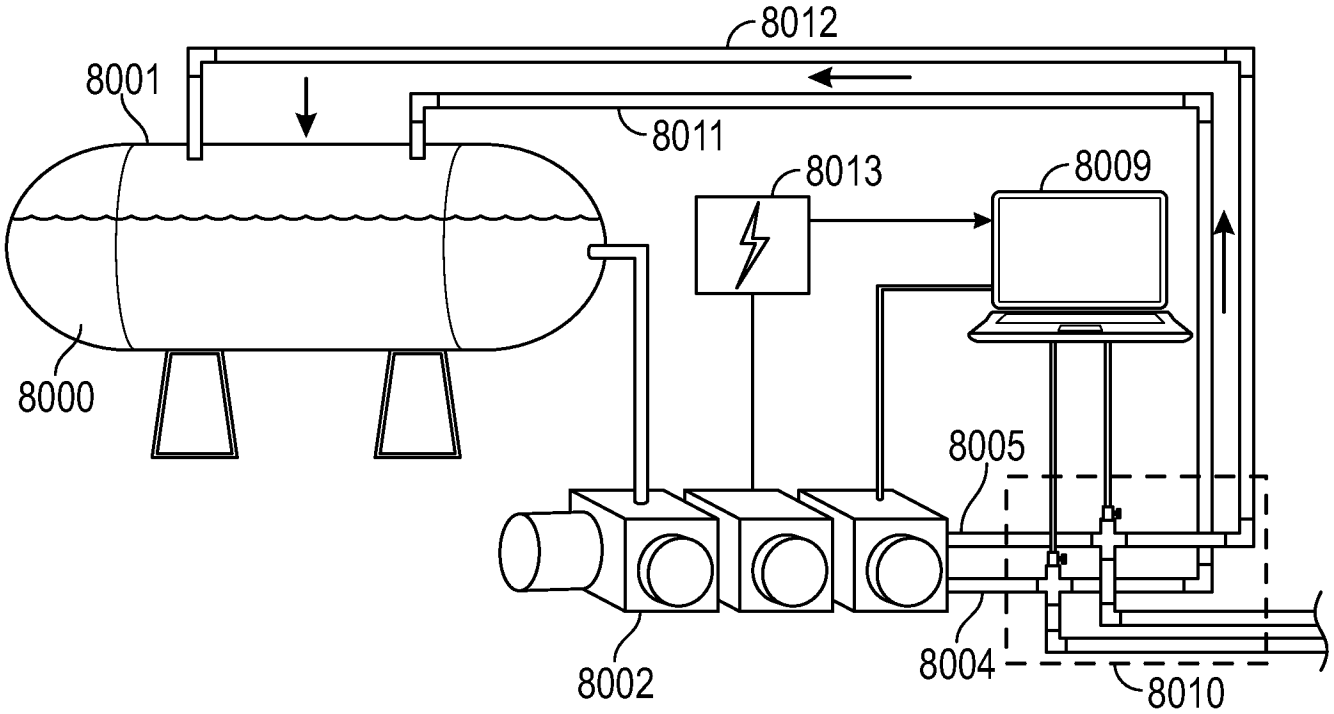
FIGS. 8 and 8A-8D depict a high level view of the surface and downhole apparatus for a rodless pump system.
Figure 8A:
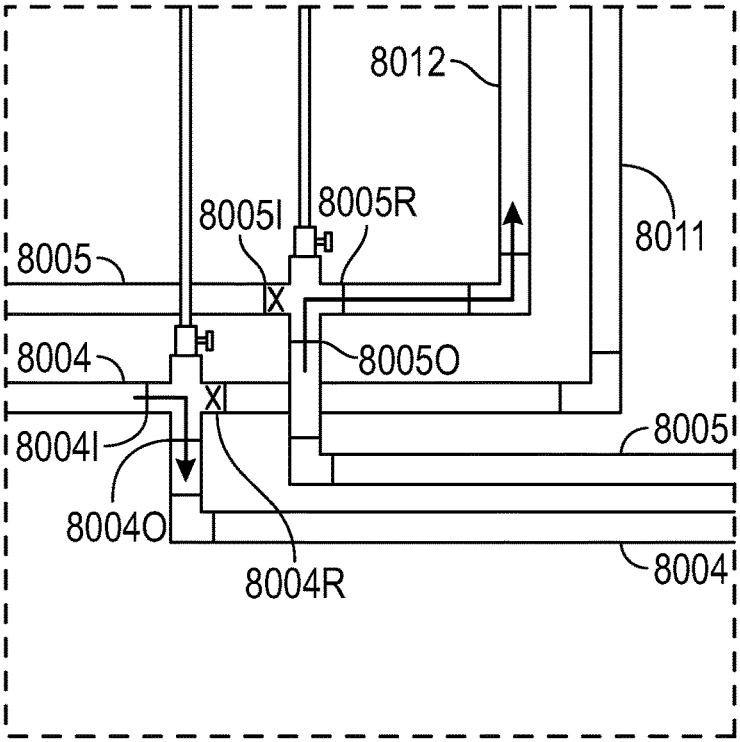
Figure 8B:
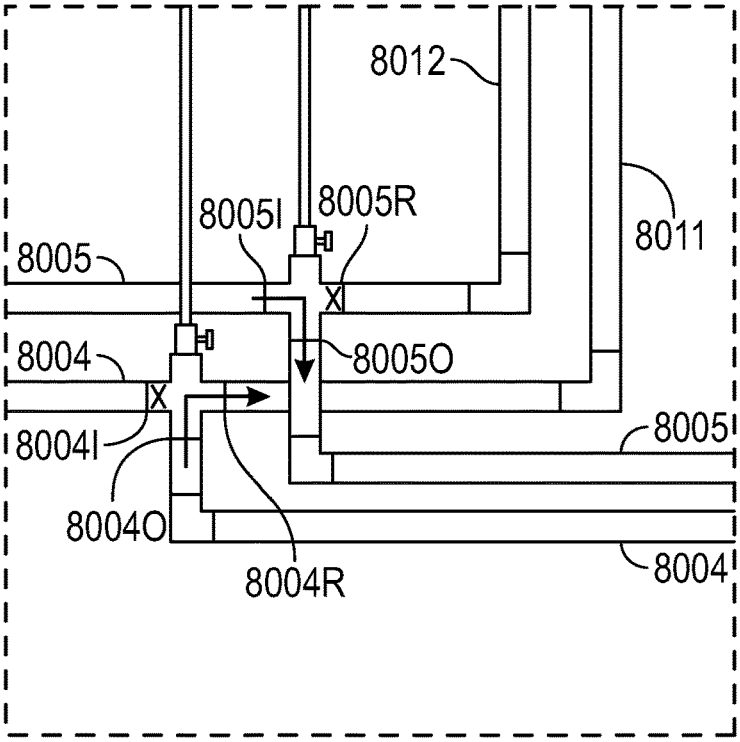
Figure 8C:
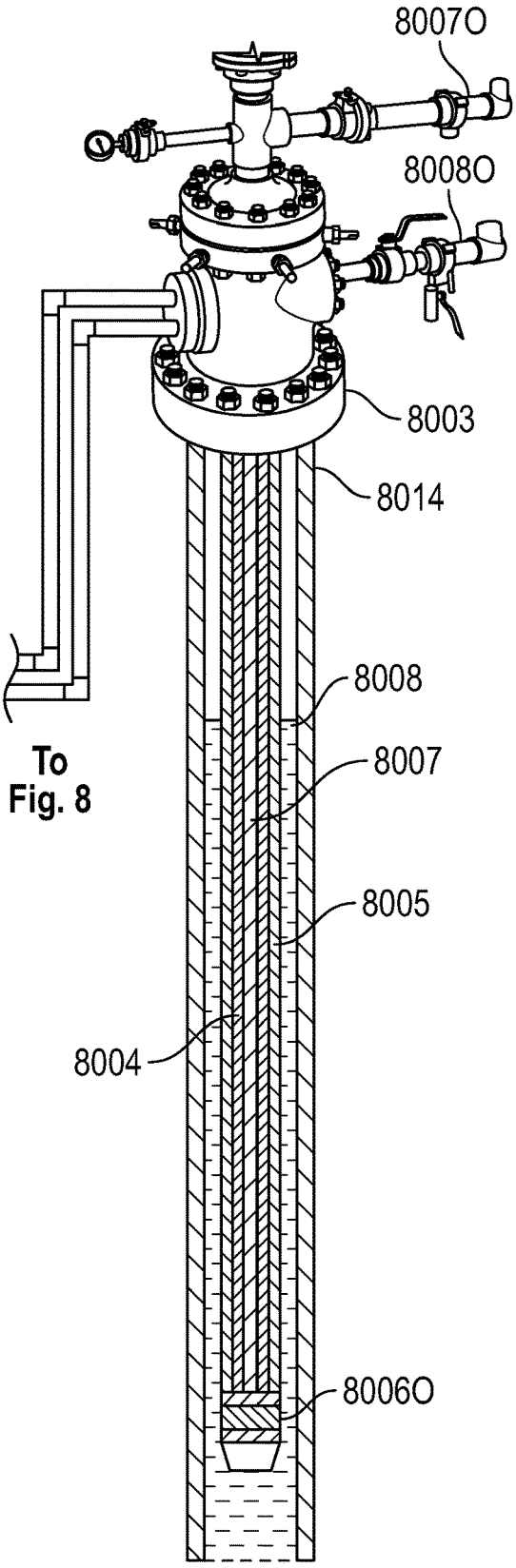
Figure 8D:
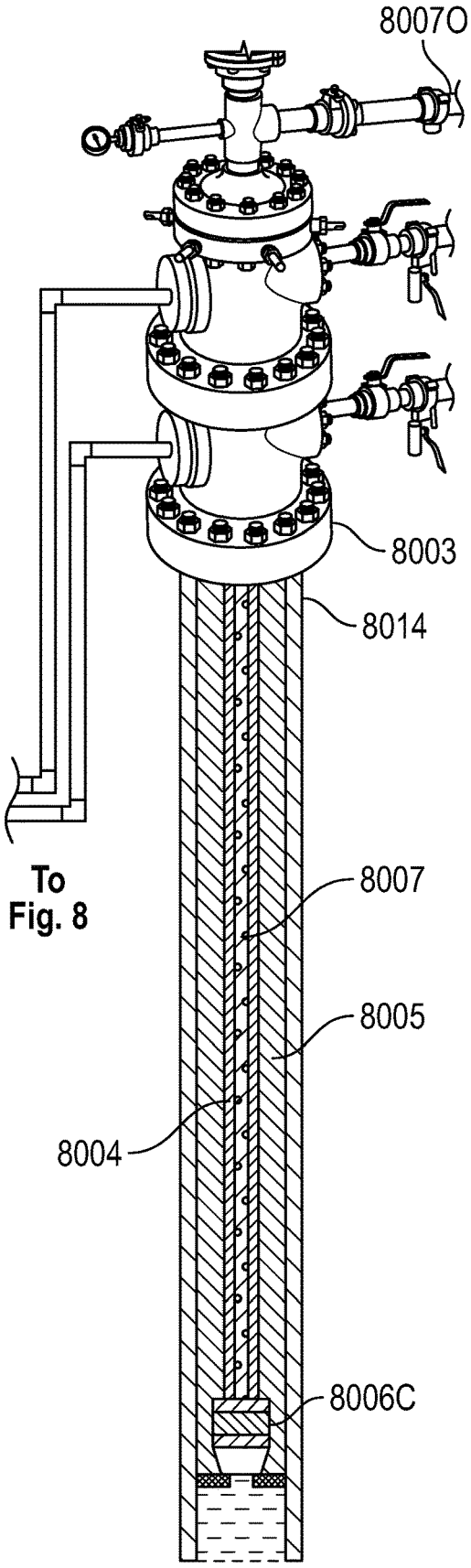

FIGS. 8 and 8A-8D depict a high level view of the surface and downhole apparatus for such a pump system. FIGS. 8A and 8B depict the surface flows of power fluids. FIG. 8C depicts an open annulus pumping setup, and FIG. 8D depicts a closed annulus setup with a pump run above a packer. Power fluid 8000 may be stored in a reservoir vessel 8001 that feeds a surface hydraulic pump 8002. The surface hydraulic pump may use multiple power fluid lines, including an upstroke line 8004 and a downstroke line 8005, that can carry the power fluid in independent conduits through the wellhead 8003 to the open annulus hydraulic sub 8006O, or closed annulus hydraulic sub 8006C disposed on the production tubing. The hydraulic sub may house the landed pump. The pump may be mechanically lowered or pumped into the wellbore and landed in a hydraulic sub that connects the power fluid chambers in the pump to the surface system via power fluid lines 8004 and 8005. Multiple seals exterior to the pump may contact their mating seal areas on the interior of the hydraulic sub to force the power fluid separately into the upstroke and downstroke power fluid chambers of the pump.

The wellhead 8003 may have multiple power fluid lines entering it, as well as an outlet 8007O for produced fluids produced by the pump up the production tubing 8007. Wellhead 8003 may also have an outlet for free gas 8008O that flows up the annulus 8008 between the production tubing, power fluid conduits, and well casing 8014. The closed annulus setup illustrated in FIG. 8D does not have an outlet for free gas because the annulus between the exterior of the upstroke power fluid string 8004 and the casing 8014 is occupied as the downstroke power fluid path 8005. The gas in the concentric setup shown in FIG. 8D is produced up the production tubing 8007 along with any other production fluids such as oil or water. The power fluid lines in this embodiment may include the upstroke power fluid line 8004 and the downstroke power fluid line 8005. A surface electronic controls system 8009 can control both the hydraulic surface pump and the valve system 8010 that direct flow to and from the well.

Return power fluid flow from the well may be taken through the upstroke return line 8011 and the downstroke return line 8012 and collected back in the power fluid reservoir for reuse. FIG. 8 depicts a single power fluid reservoir, but separate power fluid reservoirs may be used if use of different power fluids for the upstroke and downstroke lines is desirable. The valve system 8010 for the upstroke line may include inlet 8004I, outlet 8004O, and return 8004R flow paths. The valve system for the down stroke line may include inlet 8005I, outlet 8005O, and return 8005R flow paths. On the upstroke, flow paths 8004I, 8004O, 8005O, and 8005R may be open and flow paths 8005I and 8004R may be closed as shown in FIG. 8A. On the downstroke, flow paths 8005I, 8005O, 8004O, and 8004R may be open and flow paths 8004I and 8005R may be closed as shown in FIG. 8B. With a contained, multiple line power fluid setup and an open annulus, oil and water may be produced up the well's tubing to a flow line for further separation or sale, and gas may flow up the annulus between the production tubing and the casing to be produced via a gas line, reducing or eliminating the need for power fluid/produced fluid separation on surface. In a closed annulus setup, the oil, gas, and water all flow up the production tubing to surface for separation into saleable products.

The system may be powered by a number of power sources 8013 including grid electricity, solar cells and batteries, diesel or natural gas powered generators, etc. The surface pump may be individually powered by an independent power source, or it may use the same power source as the electronic controls system. The surface pump may alternatively use the transmission and drive system of a converted prime mover or surface unit from a traditional rod pump system.

Figure 9C:
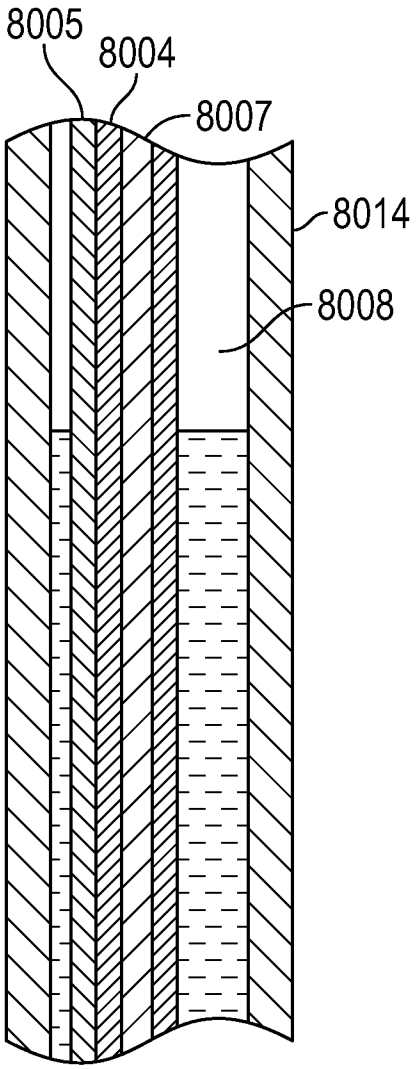
FIGS. 9A-9C show fluid conduit paths for open annulus setups without a packer.
Figure 9B:
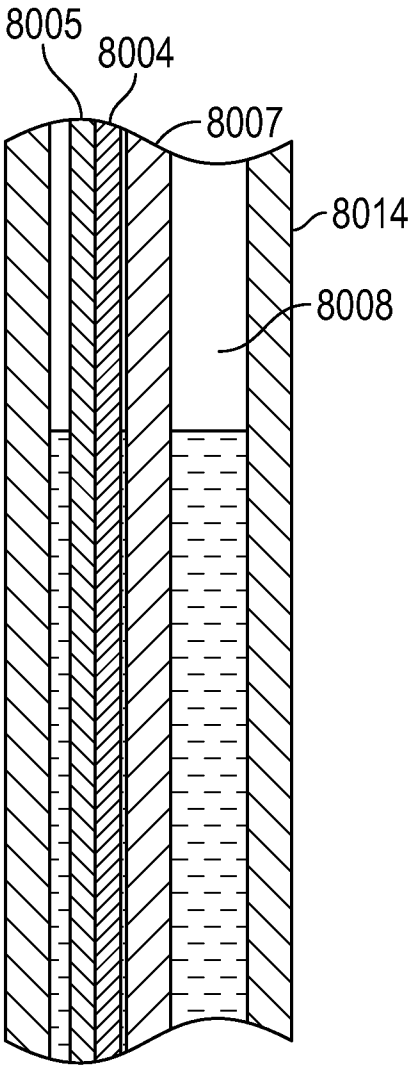
Figure 9A:
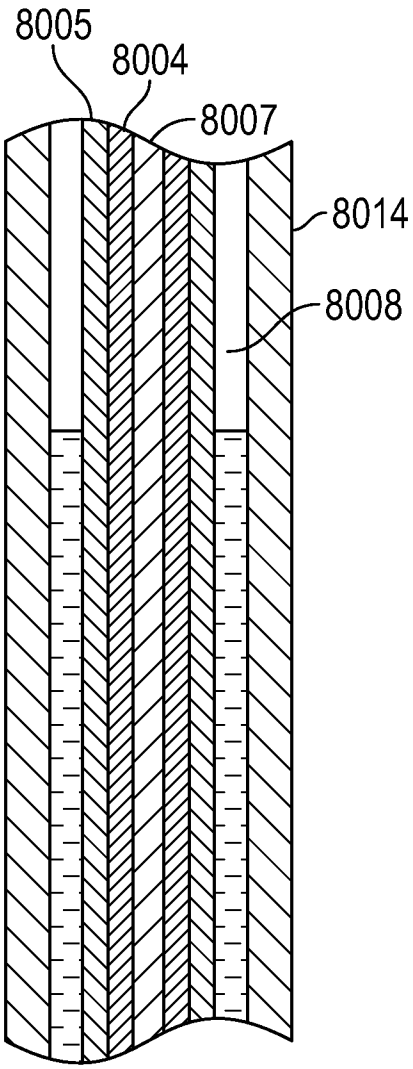
Figure 10C:
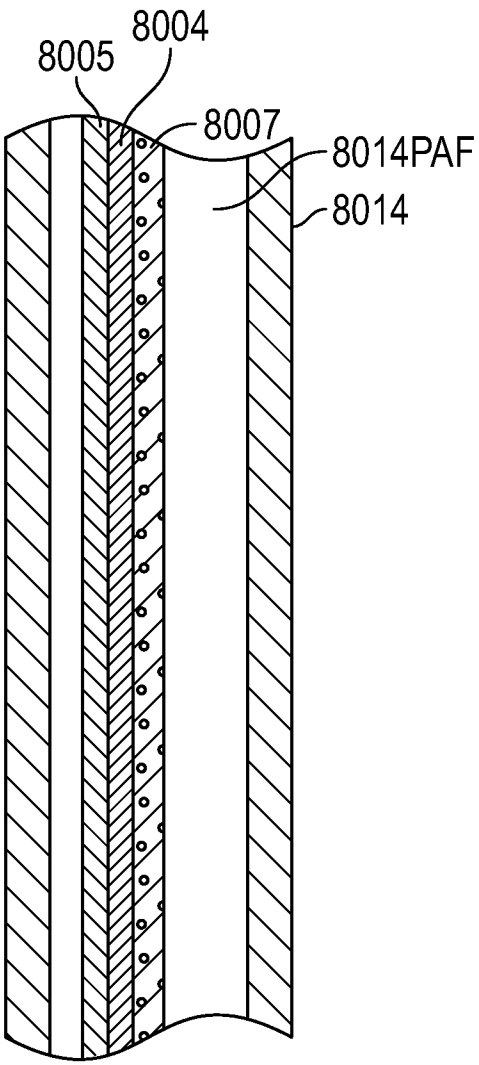
FIGS. 10A-10C show fluid conduit paths for closed annulus setups.
Figure 10B:
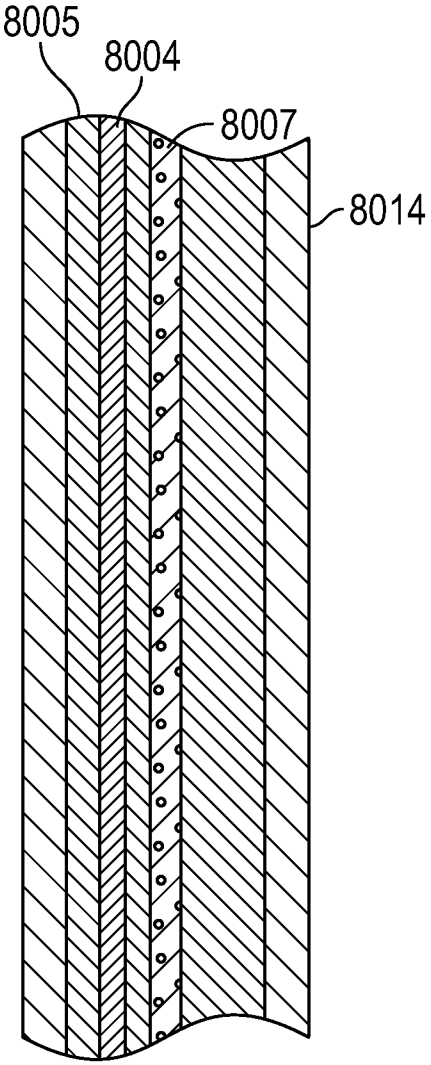
Figure 10A:
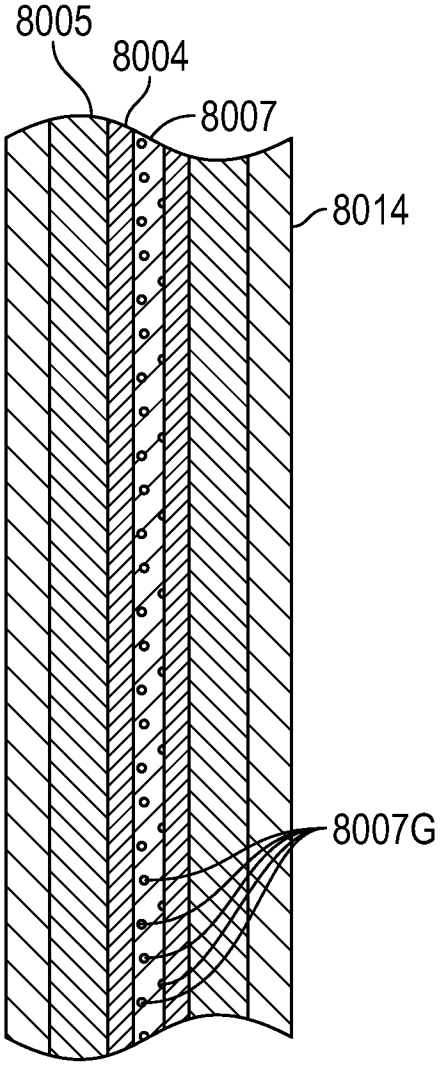

FIGS. 9A, 9B, 9C, and 10A, 10B, and 10C show the fluid conduit paths for upstroke line 8004 and downstroke line 8005 as they travel from the surface downhole to the pump. FIGS. 9A, 9B, and 9C depict open annulus setups without a packer. FIGS. 10A,10B, and 10C show closed annulus setups. As shown in FIG. 9A, upstroke line 8004 and downstroke line 8005 may be concentric to the production tubing 8007, with an open annulus 8008 that allows for a fluid level above the pump and for free gas to flow to surface. As shown in FIG. 9B, the upstroke line 8004 and downstroke line 8005 may be separate and independent from the production tubing 8007, with an open annulus 8008. As shown in FIG. 9C, a hybrid design may include one concentric power fluid string 8004 and one independent power fluid string 8005, with an open annulus 8008.

FIG. 10A depicts a concentric, closed annulus setup with the packer seal not pictured. The first power fluid string 8004 may be a separate string of tubing run concentrically to the production tubing. The second fluid flow path may be in the annulus between the exterior of the first power fluid string 8004 and the casing 8014. Gas bubbles 8007G are shown mixed with fluids in the interior of the production tubing string 8007 in FIGS. 10A, 10B, and 10C. In closed annulus setups, there is not a free annulus for gas to separate out of the produced fluid and flow up the casing. The gas 8007G may be entrained in the oil and water mixture and produced up the production tubing. FIG. 10B depicts a nonconcentric closed annulus setup. One power fluid line 8004 may be run exterior to and independent of the production tubing 8007. The second fluid flow path may be in the exterior space between the first power fluid string 8004, the production tubing, and the casing 8014. FIG. 10C depicts an independent, dual power fluid string, closed annulus setup. Both power fluid lines 8004 and 8005 may be run exterior to and independent of the production tubing 8007. The space inside the casing not occupied by power fluid lines or production tubing may be filled with a packer fluid 8014PAF.

Figure 11:
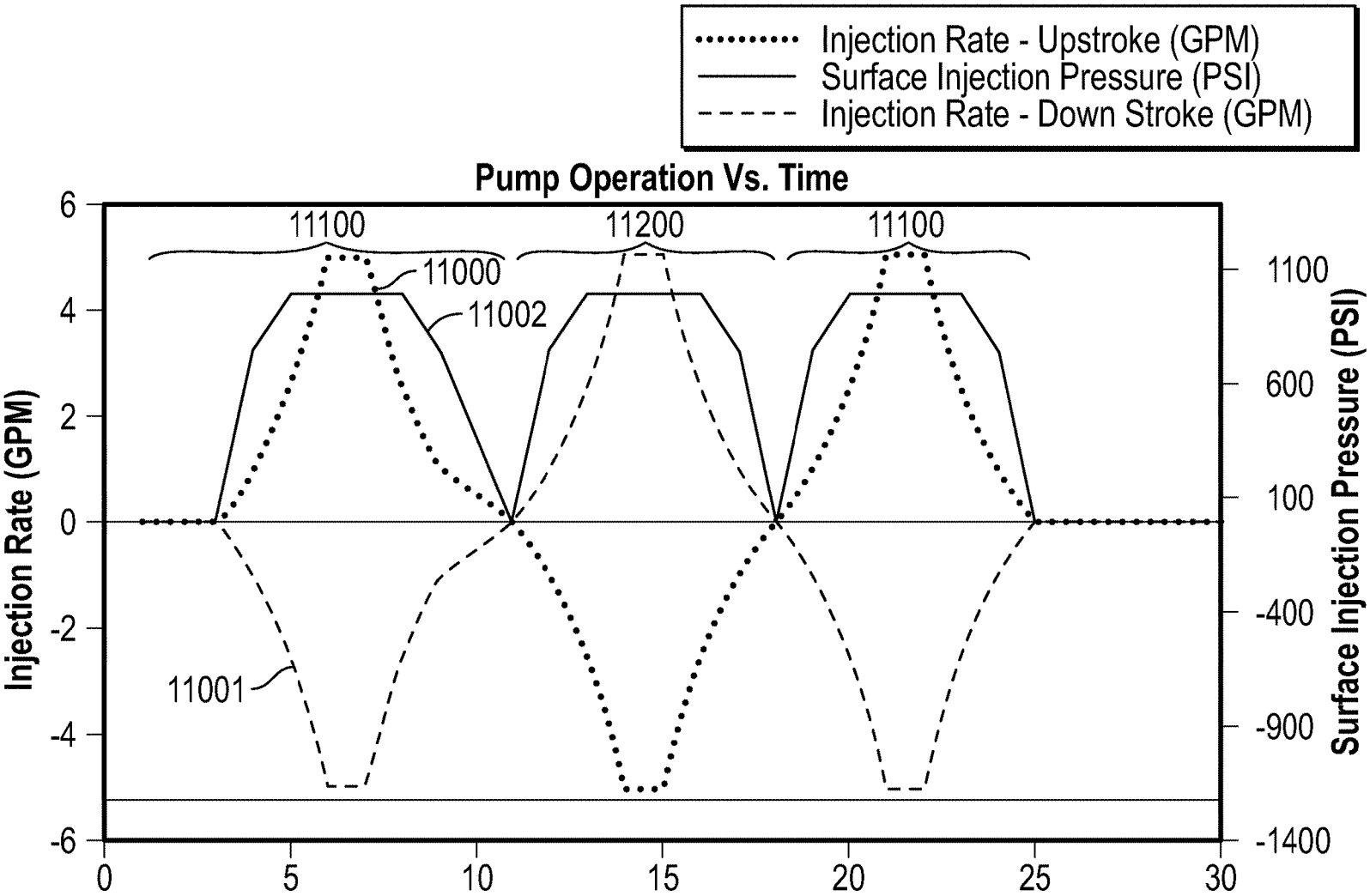
FIG. 11 shows the relationship between power fluid flow rate in the upstroke working chamber 11000, power fluid flow rate in the downstroke working chamber 11001, and surface pump pressure 11002 over time for an exemplary pump operation.

FIG. 11 shows the relationship between power fluid flow rate in the upstroke working chamber 11000, power fluid flow rate in the downstroke working chamber 11001, and surface pump pressure 11002 over time for an exemplary pump operation. Positive pump rates are defined as power fluid going into a working chamber, and negative flow rates are defined as power fluid leaving a working chamber. For the upstroke 11100 the pump starts in a down stroked position, and fluid rate is increased in the first working chamber 11000 thereby actuating a piston assembly of the pump comprising the first working piston in a first direction while a corresponding, but not necessarily equal, negative flow rate is observed in the second working chamber 11001 thereby actuating a piston assembly of the pump in a second direction opposite the first direction. The surface pump pressure 11002 increases to overcome the friction resulting from fluid movement in the power fluid lines and hydrostatic pressure acting on the pump. On the downstroke 11200, the downstroke fluid rate increases and a corresponding, but not necessarily equal negative rate is seen leaving the first working chamber 11000. Surface pressure again rises as a result of friction in the power fluid lines and hydrostatic forces acting on the downhole pump.

Figure 12D:
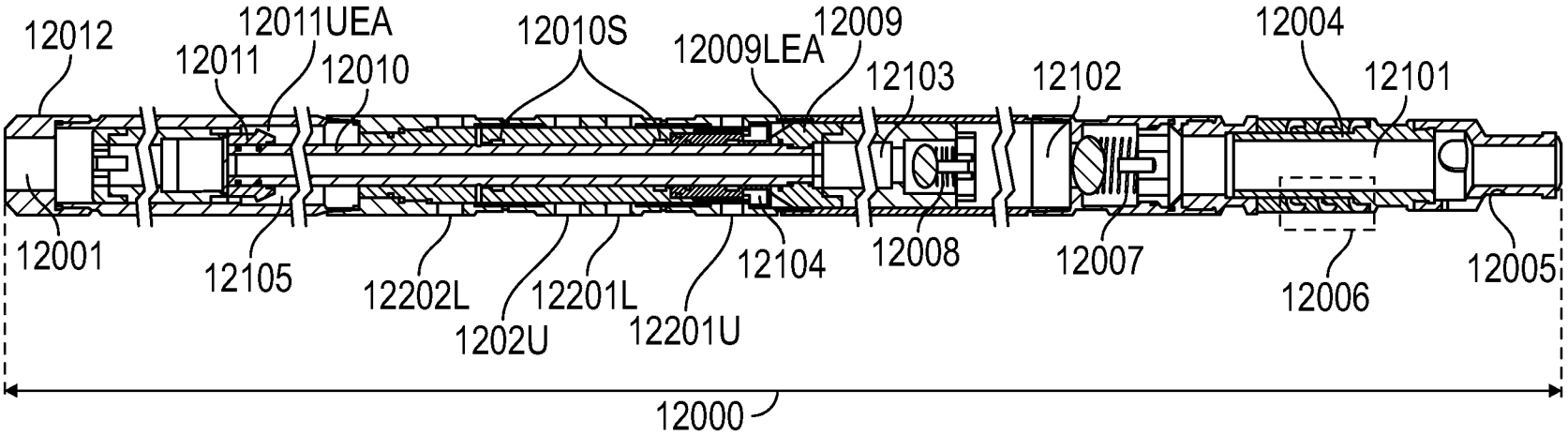
FIGS. 12DS and 12US illustrate a "rig-less" rodless pump in the downstroke and upstroke positions, respectively FIG. 12HS depicts a hydraulic sub receptacle for an open annulus system without a rodless pump landed in it.
Figure 12U:
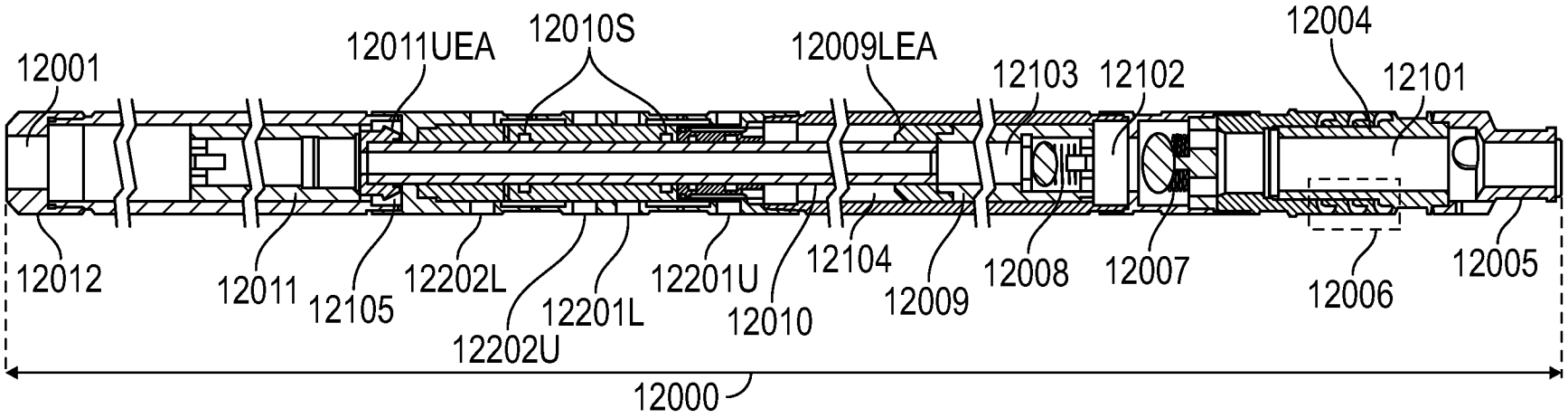

FIGS. 12DS and 12US illustrate a rodless pump 12000 that may be retrieved without a workover rig, described herein as a "rig-less version". The rig-less version of the pump is not threaded into the production tubing string; thus a rig is not necessary to retrieve it. Rig-less rodless pump 12000 may include a fishing neck 12005 that allows for retrieval via latching with coil tubing, slick line, wire line, or a workover tubing string. Rig-less rodless pump 12000 may be constructed the same for both closed and open annulus systems. The hydraulic sub, however, may differ between a closed annulus hydraulic sub 8006C and open annulus hydraulic sub 8006O systems.

Rig-less rodless pump 1200 may include: fishing neck 12005, upper hold down sub 12006, hold down seals 12004, standing check valve 12007, traveling check valve 12008, upper working piston 12009, connecting rod 12010, connecting rod seals 12010S, lower working piston 12011, bottom intake 12001, and bullnose 12012. The standing check valve and traveling check valves are illustrated as spring-loaded ball and seat arrangements, although other types of check valves may be used, such as a flapper, dart, or caged ball check valves. The traveling check valve is pictured in the upper working piston 12009, which can minimize non-stroked volume within the pump chamber. However, the traveling check may also be placed within the lower working piston or the connecting rod. In some embodiments, a standing check may be located below the traveling valve. The upper working piston 12009 may be connected to the lower working piston 12011 by connecting rod 12010. The connecting rod 12010 may contact the connecting rod seals 12010S that may isolate the pressure between the upper power fluid chamber 12104 and lower power fluid chamber 12105. The connecting rod seals 12010S are pictured as O-ring type seals but may also be a metal-to-metal type seal. The production fluid chambers can include the production lift chamber 12101, the pump chamber 12102, and the reservoir/wellbore fluid chamber 12103. The power fluid chambers can include the upstroke power fluid chamber 12104 and the downstroke power fluid chamber 12105. The power fluid in the upstroke power fluid chamber 12104 exerts a force on the lower exposed area of the upper working piston 12009LEA to actuate the pump up. The power fluid in the downstroke power fluid chamber 12105 exerts a force on the upper exposed area of the lower working piston 12011UEA to actuate the pump down. The power fluid in the upstroke power fluid line 8004 may be in hydraulic communication with the upstroke power fluid chamber via a port and a multiple seal arrangement on the interior of the hydraulic sub. The power fluid in the downstroke power fluid line 8005 may be in hydraulic communication with the downstroke power fluid chamber via a port and a multiple seal arrangement on the interior of the hydraulic sub.

Figure 12H:
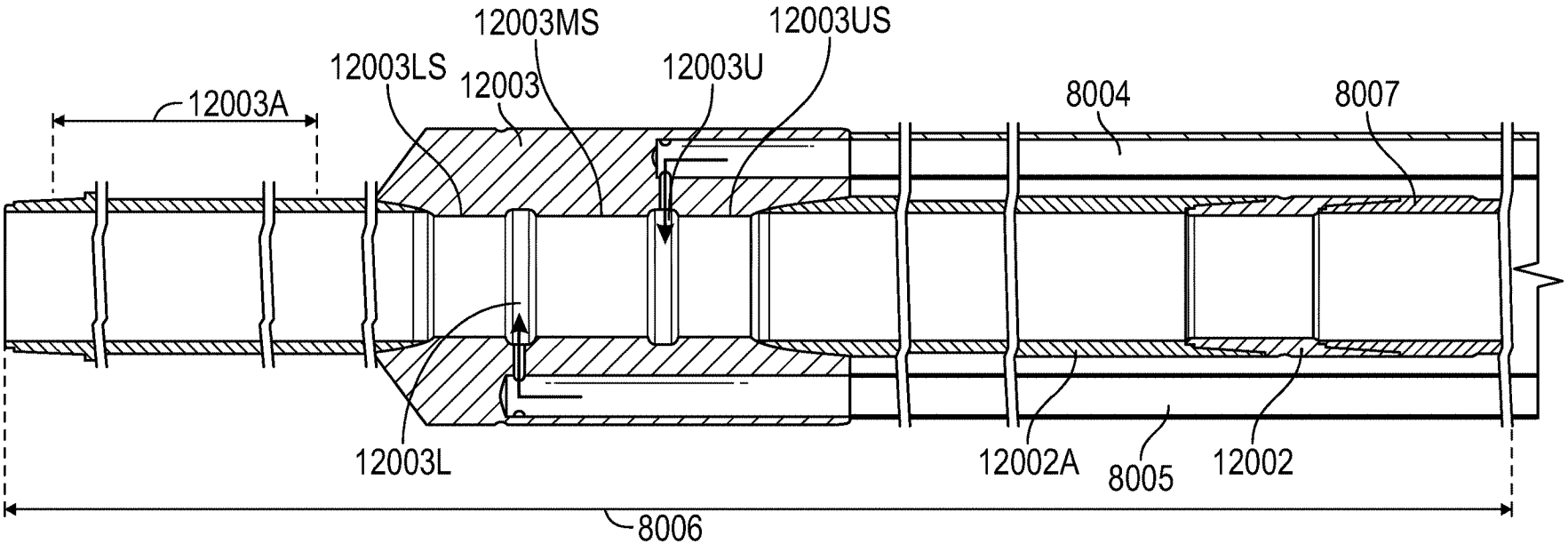

FIG. 12HS depicts an exemplary hydraulic sub receptacle for an open annulus, rig-less system 8006O without a rodless pump landed therein. The hydraulic sub may be threaded on the bottom of the production tubing string 8007 and may include an assembly of parts exterior to the pump, such as the landing sub 12002, pump chamber housing 12002A, power fluid seal sub 12003, and lower piston housing 12003A. Because the seals isolating the lower power fluid chamber from the downhole production fluids are located up hole of the lower piston housing 12003A, a standard tubing joint may function as a lower piston housing and attach to the bottom of the power fluid seal sub 12003. Further apparatus such as sand separators, gas separators, or tubing anchors may be affixed to the bottom of the lower piston housing/production tubing joint.

The production tubing may have a landing sub above the pump 12002 that contacts the hold down seals on the pump 12004. The hydraulic fluid seal sub may include upper and lower recesses 12003U, 12003L that may allow flow from the power fluid lines 8004, 8005 into the upper power fluid chamber 12104 and lower power fluid chambers 12105, respectively. The hydraulic power fluid seal sub may also include seal areas 12003LS, 12003MS, and 12003US that mate with the lower pump seals 12202L, middle pump seals 12202U and 12201L, and upper pump seals 12201U, respectively. This combination of upper and lower recesses surrounded by three sealing areas that seal above the top recess 12003US, in between the two recesses 12003MS, isolating the flows between the two power fluid chambers, and below the bottom recess 12003LS, isolate the lower power fluid chamber from the wellbore fluids. This seal arrangement may allow the power fluid conduits to actuate the pump in the upstroke and downstroke directions without materially mixing power fluid and production fluid. This seal arrangement may also allow rig-less retrieval of the pump.

Figure 12:
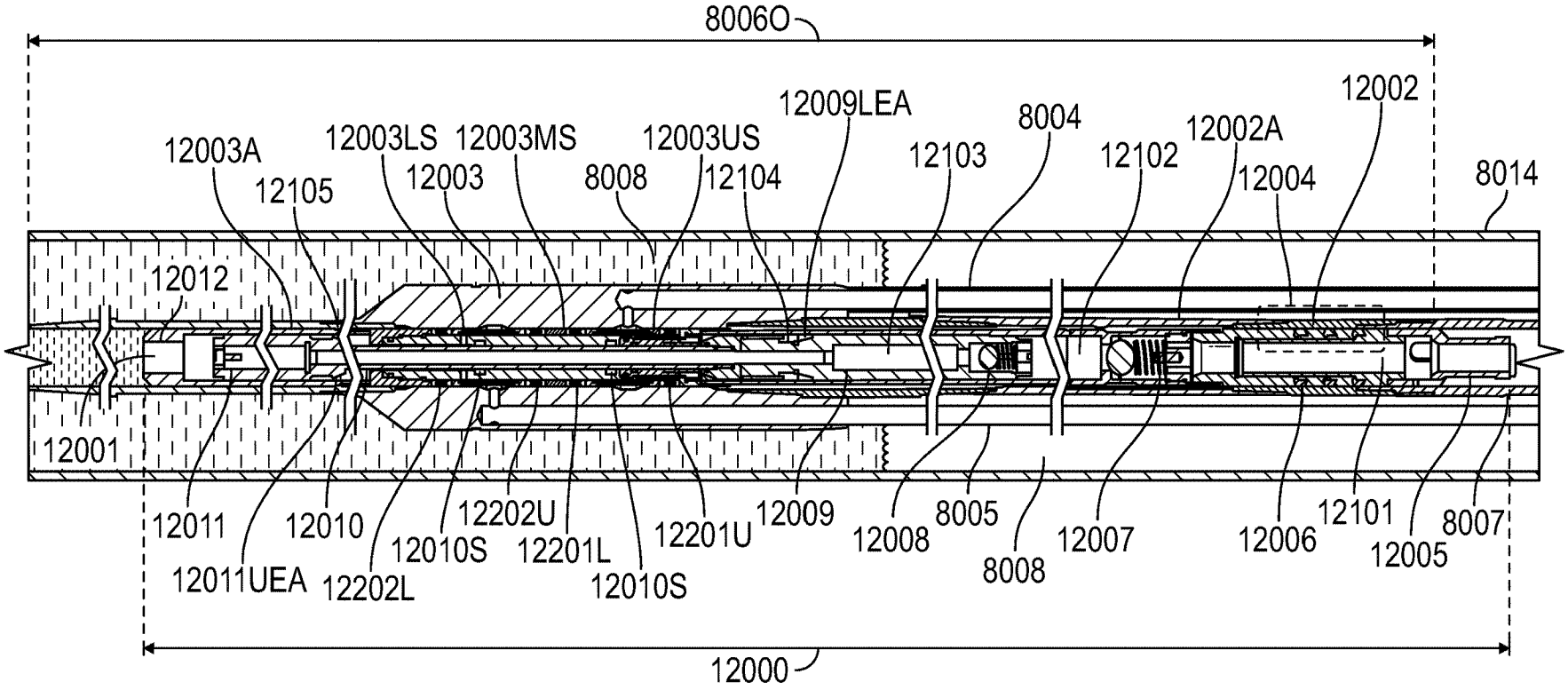
FIG. 12 illustrates a rodless pump landed inside an open annulus hydraulic sub disposed on the end of production tubing, with production fluids filling the outer annulus inside the production casing.

FIG. 12 illustrates a rig-less rodless pump 12000 landed inside an open annulus hydraulic sub 8006O disposed on the end of production tubing 8007 with production fluids filling the outer annulus 8008 inside the production casing 8014. Production tubing 8007 may be run into the well with the rodless pump 12000 already landed inside the hydraulic sub 8006O. Alternatively, the pump 12000 may be landed at a time after the production tubing and hydraulic sub are run into the well. The exterior power fluid strings may be run into the well at the same time as the production tubing string. The pump 12000 may be landed in the hydraulic sub 8006O that may be connected independently to both the upstroke power fluid conduit 8004 and the downstroke power fluid conduit 8005. An upper landing sub 12006 is pictured above the upper working piston 12009 of the pump, but a similar lower landing sub below the lower working piston 12011 could be used for a bottom hold down.

The hydraulic sub may include hydraulic power fluid seal sub 12003. The hydraulic power fluid seal sub and landing sub may be used to hold the rodless pump in the wellbore and to transfer the power fluid from the power fluid lines to and from the pump with minimal mixing of power fluid and production fluid. When the pump 12000 is landed in the hydraulic sub 8006O, seals above and below both power fluid conduits may be engaged by the power fluid seal sub 12003, thereby forcing the fluid from the upstroke conduit through the upper recess 12003U and into the upstroke chamber 12104 and forcing fluid from the downstroke conduit through the lower recess 12003L into the downstroke chamber 12105. The upstroke fluid chamber seals are 12201U and 12201L, and the downstroke chamber seals are 12202U and 12202L. Seals 12201L and 12202U may be combined into a single seal in some embodiments. These seals contact seal areas 12003LS, 12003MS, and 12003US to force upstroke power fluid from line 8004 in between seal areas 12003MS and 12003US into the upstroke power fluid chamber 12104 and downstroke power fluid from line 8005 in between seal areas 12003MS and 12003LS into the downstroke power fluid chamber.

FIGS. 12A, 12B, 12C, and 12D depict fluid flows through a rodless pump with open annulus and independent power fluid lines. The arrows in FIGS. 12A, 12B, 12C, and 12D in the upstroke and downstroke lines show the direction of power fluid and production fluid during the upstroke and downstroke. On the downstroke, power fluid is flowing into the pump through the downstroke line and out of the pump, towards surface, in the upstroke line. On the upstroke, power fluid is flowing into the pump through the upstroke line and out of the pump, towards surface, in the downstroke line.

Figure 12A:
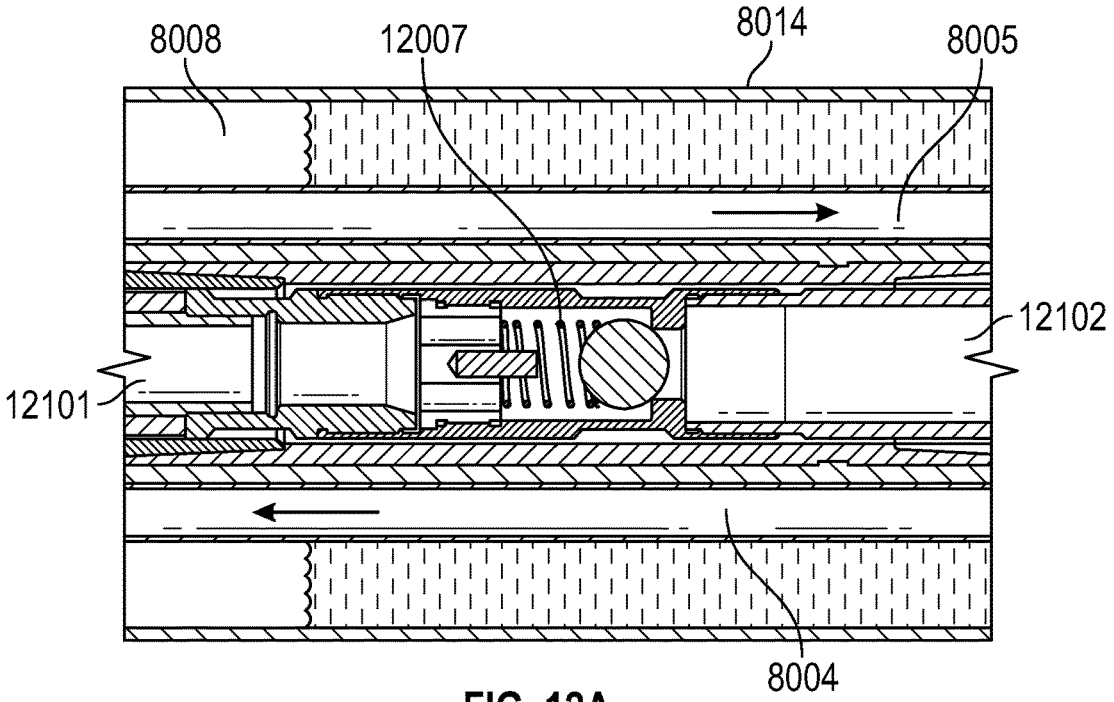
Figure 12B:
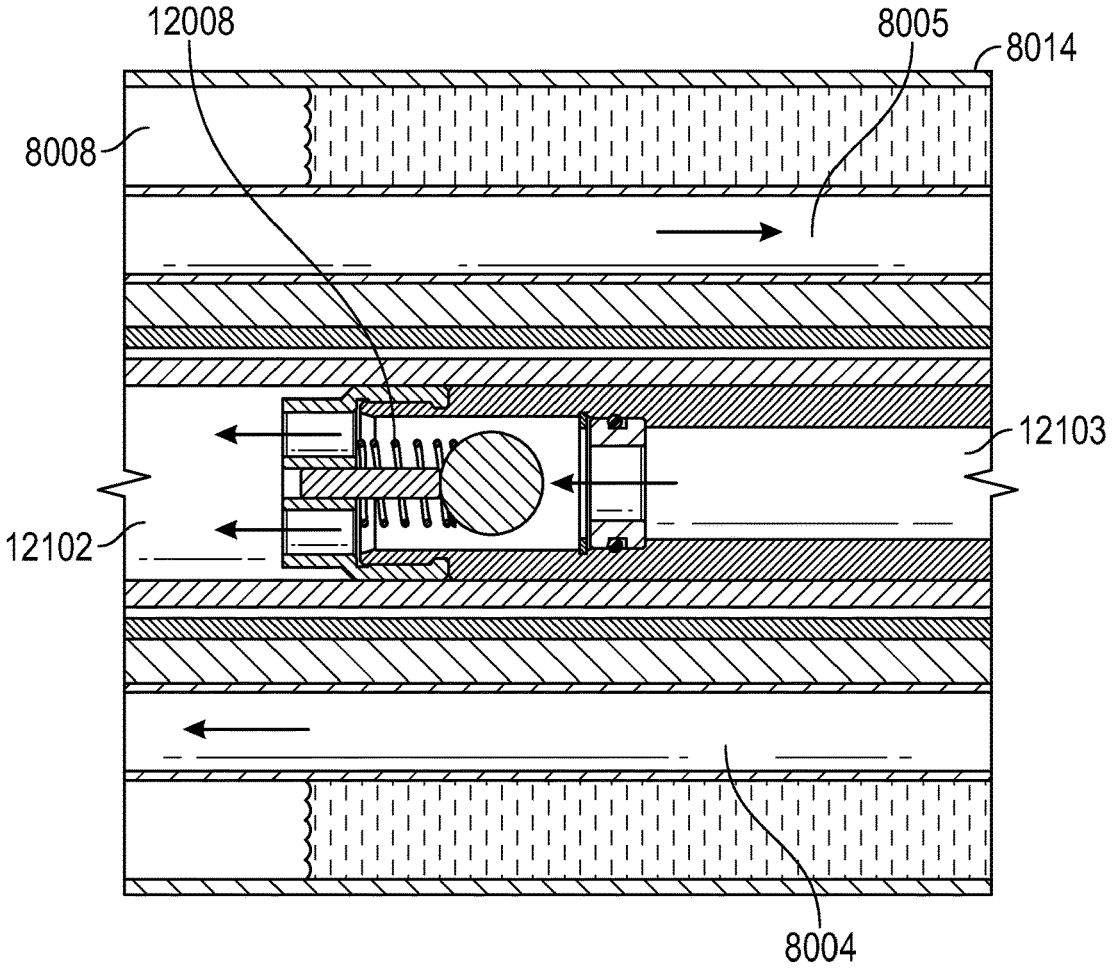

FIG. 12A depicts standing check valve 12007 in the closed position on the downstroke. FIG. 12B depicts traveling check valve 12008 in the downstroke, unseated position allowing fluid to pass. During the downstroke, standing check valve 12007 may be seated, and traveling check 12008 may be unseated, allowing fluid to pass from wellbore fluid chamber 12101 into pump chamber 12102. Wellbore fluid may enter into the rodless pump from bottom production fluid intake 12001 and may travel into the lower working piston 12011, and then into the hollow connecting rod 12010. From the connecting rod wellbore fluid may travel into the upper working piston 12010, which can include the unseated traveling check valve 12008. Wellbore fluid may then enter pump chamber 12102 on the downstroke.

Figure 12C:
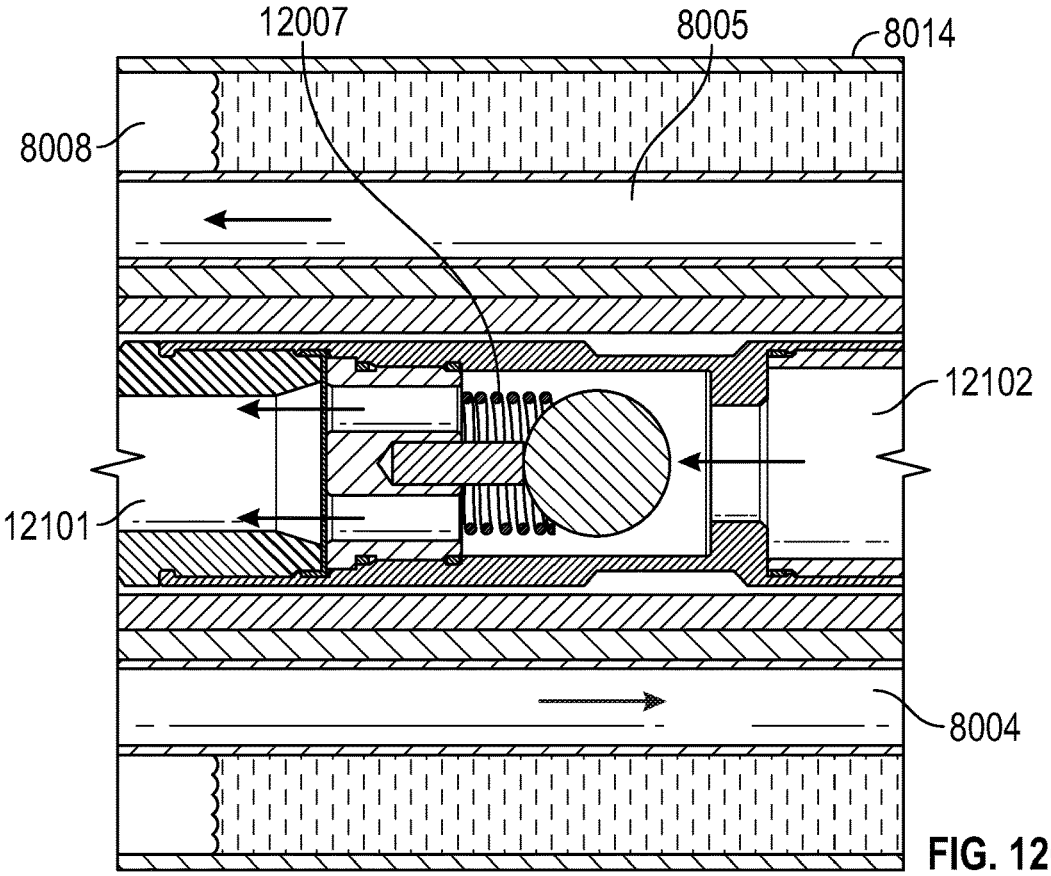
Figure 12D:
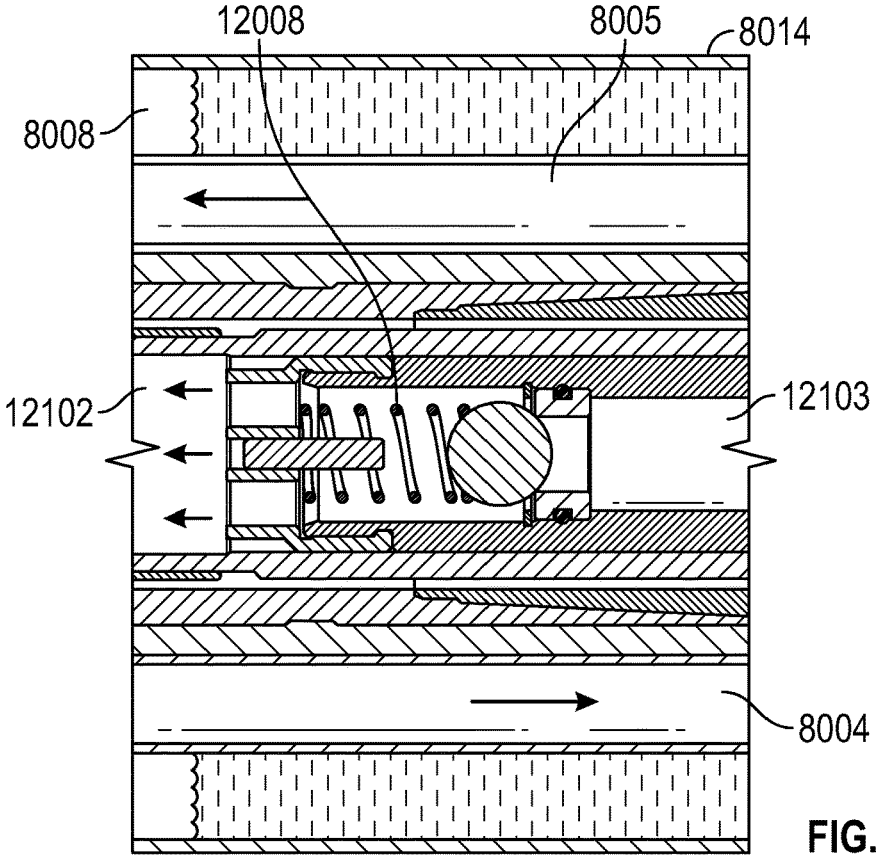

FIG. 12C depicts the standing check valve 12007 in the upstroke, unseated position allowing fluid to pass. FIG. 12D depicts the traveling check valve 12008 in the closed position on the upstroke. On the upstroke, the traveling check valve 12008 seats from the hydrostatic pressure acting on it in the production tubing 8007 and pump chamber 12105. The pressure in the pump chamber increases until the pressure exceeds the pressure in the production tubing above the standing valve 12007. As a result, the ball is moved off the seat of the standing valve as fluids flow to surface.

Figure 13H:
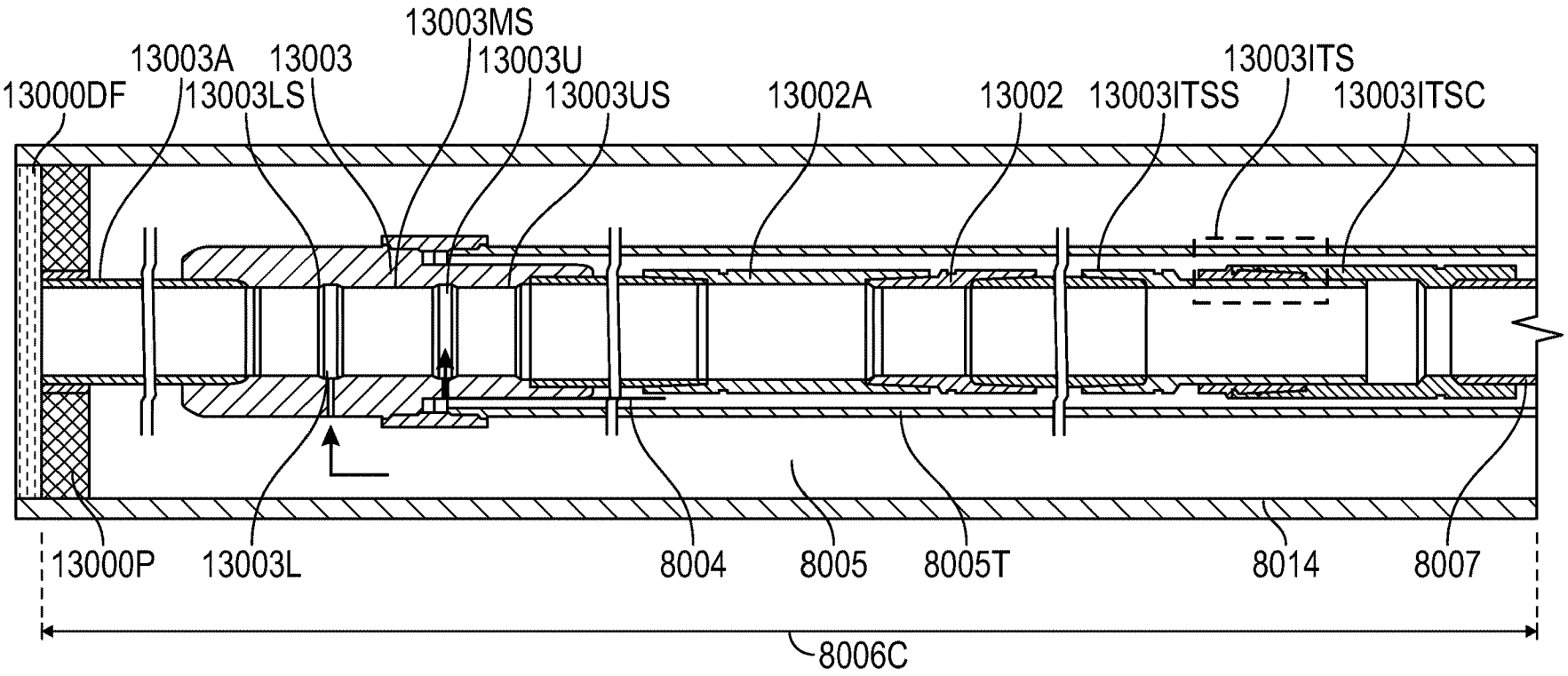
FIG. 13HS depicts a hydraulic sub receptacle for a closed annulus, rig-less rodless pump artificial lift system run above a packer to isolate the downhole fluids below.

FIG. 13HS depicts hydraulic sub receptacle 8006C for a closed annulus, rig-less rodless pump artificial lift system run above a packer 13000P that seals against the casing 8014 to isolate the downhole fluids (oil, gas, and water) 13000DF below. Packer 13000P can include an inner seal bore that the bottom of the hydraulic sub 8006C may be inserted into. The hydraulic sub may be attached to the bottom of power fluid string 8005T. The uppermost part of the hydraulic sub may be the inner tubing seal carrier 13003ITSC that is disposed on the bottom of the production tubing. At the end of the inner tubing seal carrier, inner tubing seals 13003ITS may be inserted into and seal against inner tubing seal sub 13003ITSS.

Similar to open annulus hydraulic sub 8006O, closed annulus hydraulic sub 8006C can include all parts exterior to the pump including the landing sub 13002, pump chamber housing 13002A, power fluid seal sub 13003, and lower piston housing 13003A. Because the seals isolating the lower power fluid chamber from the production fluids are located up hole of the lower piston housing 13003A, a standard tubing joint with a seal on the bottom may function as a lower piston housing and attach to the bottom of the power fluid seal sub 13003. The tubing can have a landing sub 13002 above the pump that contacts the hold down seals on the pump 12004. The hydraulic fluid seal sub can include upper and lower recesses 13003U, 13003L to allow flow into the upper power fluid chamber 12104 and lower power fluid chambers 12105, respectively. The hydraulic power fluid seal sub can also include seal areas 13003LS, 13003MS, and 13003US that mate with the lower pump seals 12202L, middle pump seals 12202U and 12201L, and upper pump seals 12201U, respectively. This combination of upper and lower recesses surrounded by a seal arrangement that seals the area above the top recess 13003US, in between the two recesses 13003MS, isolating the flows between the two power fluid chambers, and below the bottom recess 13003LS, can allow power fluid conduits to actuate a retrievable pump in the upstroke and downstroke directions without materially mixing power fluid and production fluid.

Figure 13:
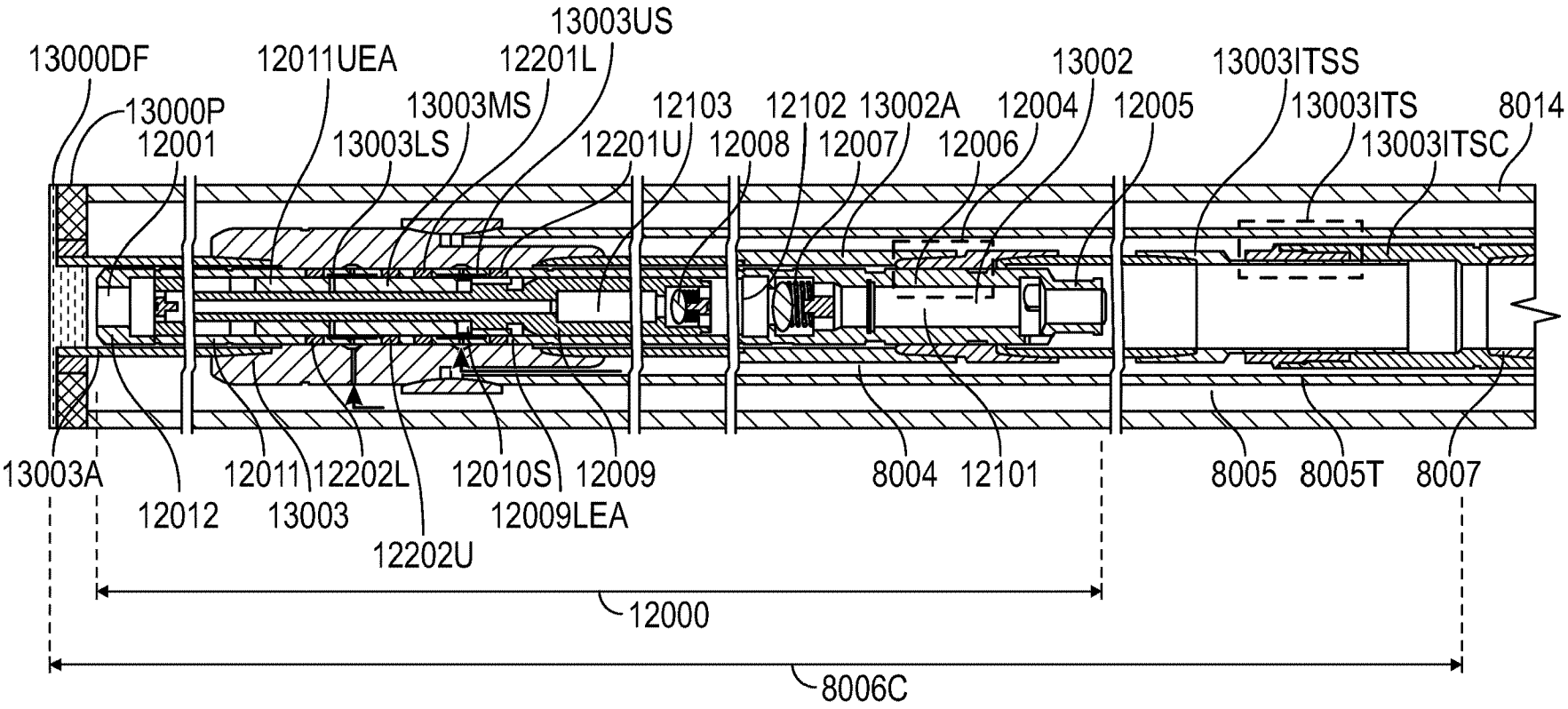
FIG. 13 illustrates a rodless pump landed inside a closed annulus hydraulic sub disposed on the end of the power fluid string, with the outer annulus serving as a downstroke power fluid conduit hydraulically contained by the production casing.

FIG. 13 shows a detailed view of a rodless pump 12000 landed inside a closed annulus hydraulic sub 8006C disposed on the end of the power fluid string 8005T with the outer annulus comprising the downstroke power fluid conduit 8005 hydraulically contained by the production casing 8014. A packer 13000P may be set in the well first via slickline or tubing. The power fluid string tubing 8005T may then be lowered into the well with the hydraulic sub 8006C disposed on the bottom of the string. The bottom seal on the hydraulic sub 8006C may be inserted into a packer 13000P that seals against the casing, with production fluids 13000DF below the packer. The pump may be landed in the hydraulic sub 8006C that is connected independently to both the upstroke power fluid conduit 8004 and the downstroke power fluid conduit 8005. An upper hold down sub 12006 is pictured above the upper working piston 12009 of the pump, but a similar lower landing sub below the lower working piston 12011 could be used for a bottom hold down. The hydraulic sub can include hydraulic power fluid seal sub 13003. The hydraulic power fluid seal sub and landing sub may be used to hold the rodless pump in the wellbore and transfer the power fluid from the power fluid lines to and from the pump with minimal mixing of power fluid and production fluid. When the pump 12000 is landed in the hydraulic sub 8006C, seals above and below both power fluid conduits may be engaged by the power fluid seal sub 13003, forcing the fluid from the upstroke conduit 8004 through the upper recess 13003U and into the upstroke chamber and fluid from the downstroke conduit 8005 through the lower recess 13003L into the downstroke chamber. The upstroke fluid chamber seals are 12201U and 12201L, and the downstroke chamber seals are 12202U and 12202L. Seals 12201L and 12202U may be combined into a single seal in some embodiments. This seal arrangement may contact the areas 13003LS, 13003MS, and 13003US to force upstroke power fluid from upstroke conduit 8004 in between seal areas 13003MS and 13003US into the upstroke power fluid chamber 12104 and downstroke power fluid from downstroke conduit 8005 in between seal areas 13003MS and 13003LS into the downstroke power fluid chamber 12105.

FIGS. 13A, 13B, 13C, and 13D depict fluid flow through a rodless pump 12000 landed in a closed annulus hydraulic sub 8006C with concentric power fluid strings 8004 and 8005. The arrows in FIGS. 13A, 13B, 13C, and 13D in the upstroke and downstroke lines show the direction of power fluid and production fluid during the upstroke and downstroke. On the downstroke, fluid is flowing into the pump through the downstroke line and out of the pump, towards surface, in the upstroke line. On the upstroke, power fluid is flowing into the pump through the upstroke line and out of the pump, towards surface, in the downstroke line.

During the downstroke, the standing check valve 12007 may be seated, and the traveling check 12008 may be unseated, allowing fluid to pass into the pump fluid chamber 12105. Wellbore fluid may enter into the rodless pump from the bottom production fluid intake 12001 and may travel into the lower working piston 12011 and then into the hollow connecting rod 12010. From the connecting rod, fluid can travel into the upper working piston 12010, which contains the unseated traveling check valve 12008. Fluid may then enter the pump chamber 12102 on the downstroke.

Figure 13A:
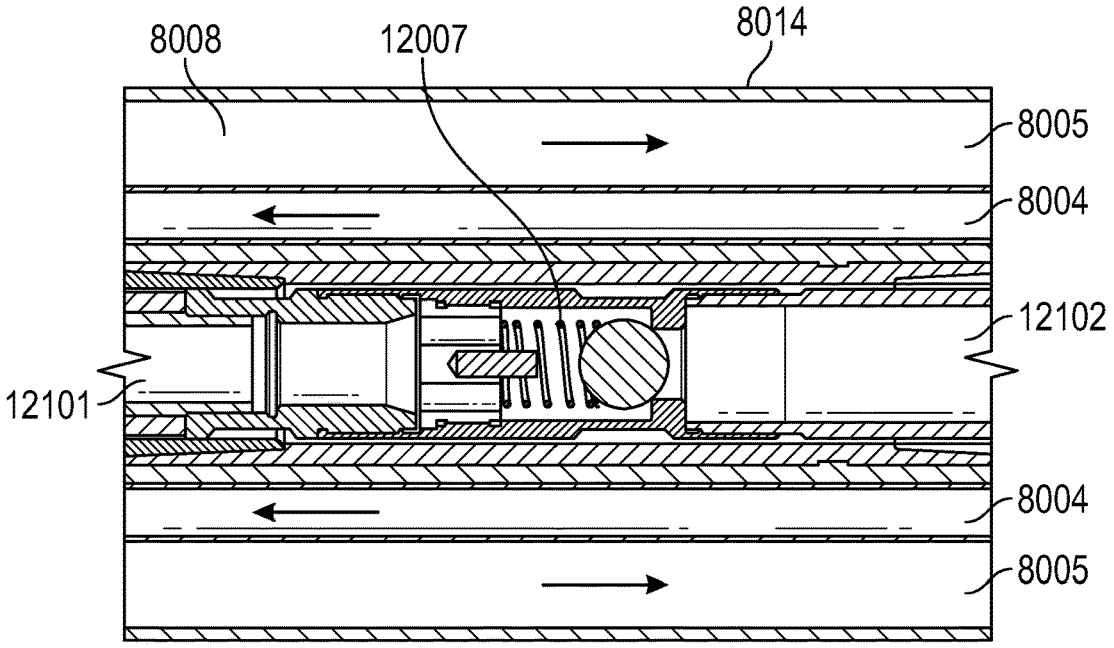
FIGS. 13A-13D depict the fluid flow through a rodless pump landed in a closed annulus hydraulic sub with concentric power fluid strings.
Figure 13B:
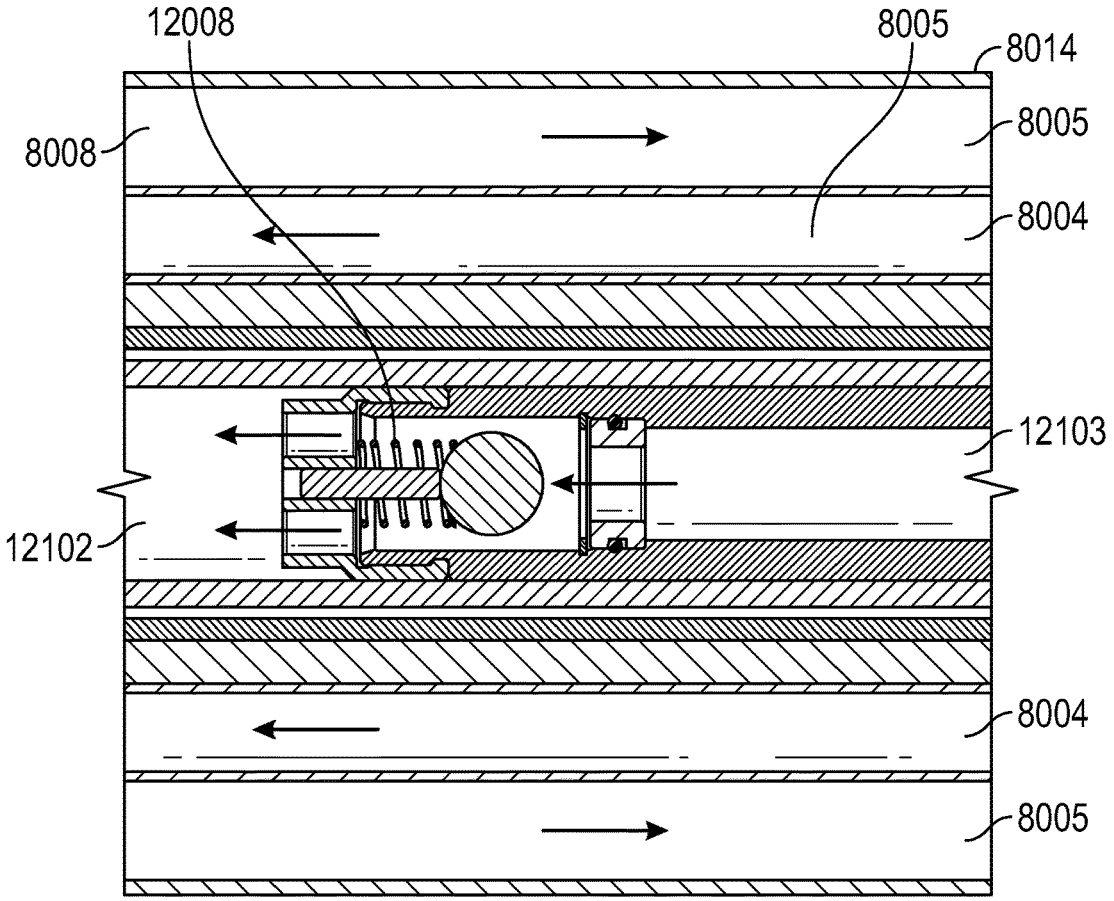

FIG. 13A depicts the standing check valve 12007 in the closed position on the downstroke. FIG. 13B depicts the traveling check valve in the downstroke, unseated position allowing fluid to pass. On the upstroke, the traveling check 12008 may seat from the hydrostatic pressure acting on it in the production tubing and pump chamber 12102. The pressure increases in the pump chamber until the pressure exceeds the pressure in the production tubing above the standing valve 12007. The ball may then move off the seat of the standing valve as fluids flow to surface.

Figure 13C:
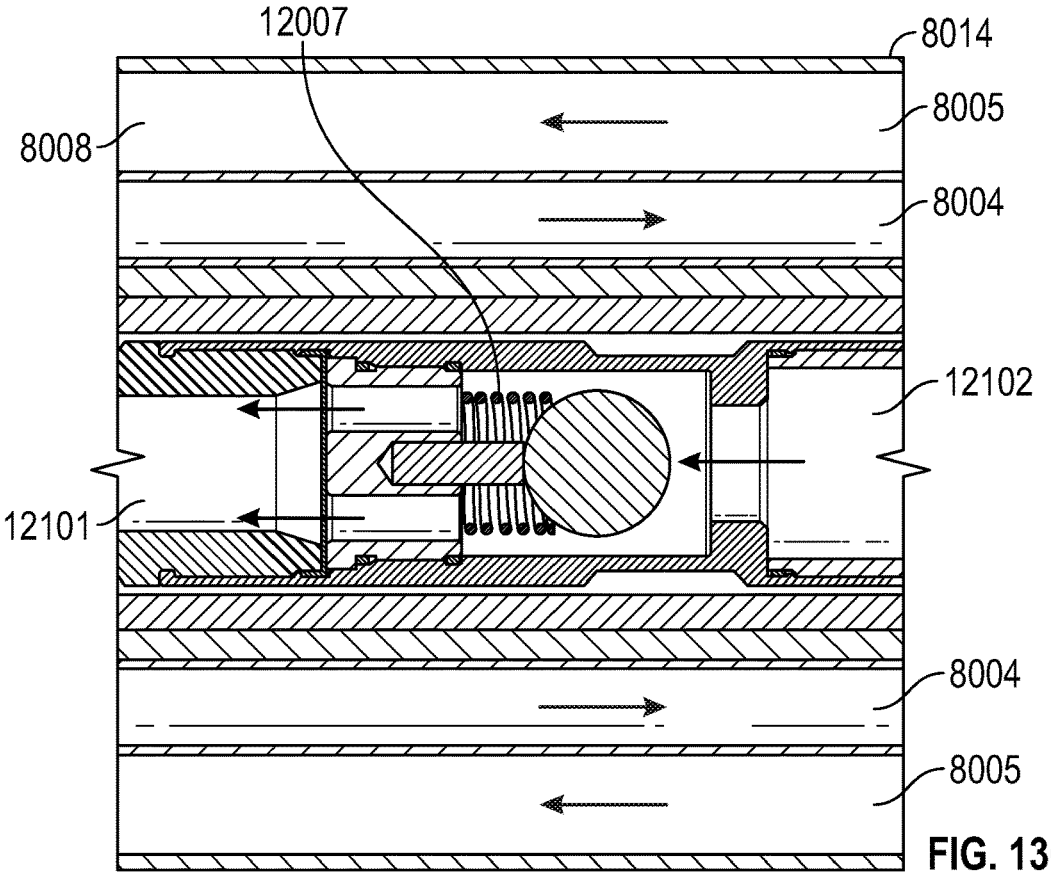
Figure 13D:
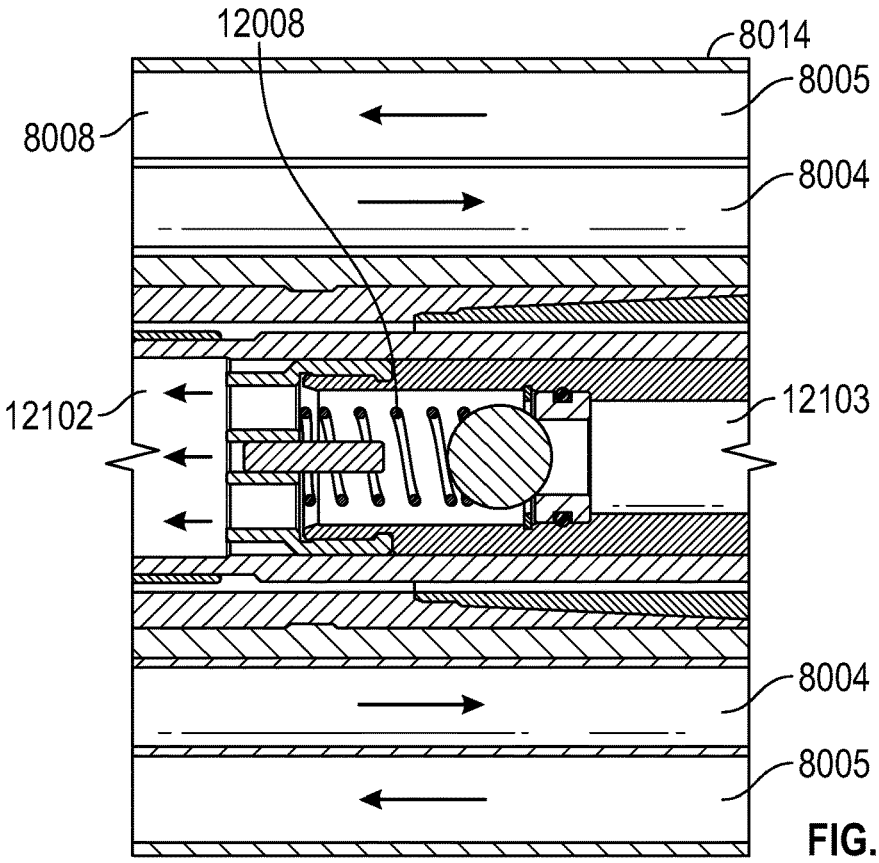

FIG. 13C depicts the standing check valve 12007 in the upstroke, unseated position allowing fluid to pass. FIG. 13D depicts the traveling check valve 12008 in the closed position on the upstroke.

Figure 14D:
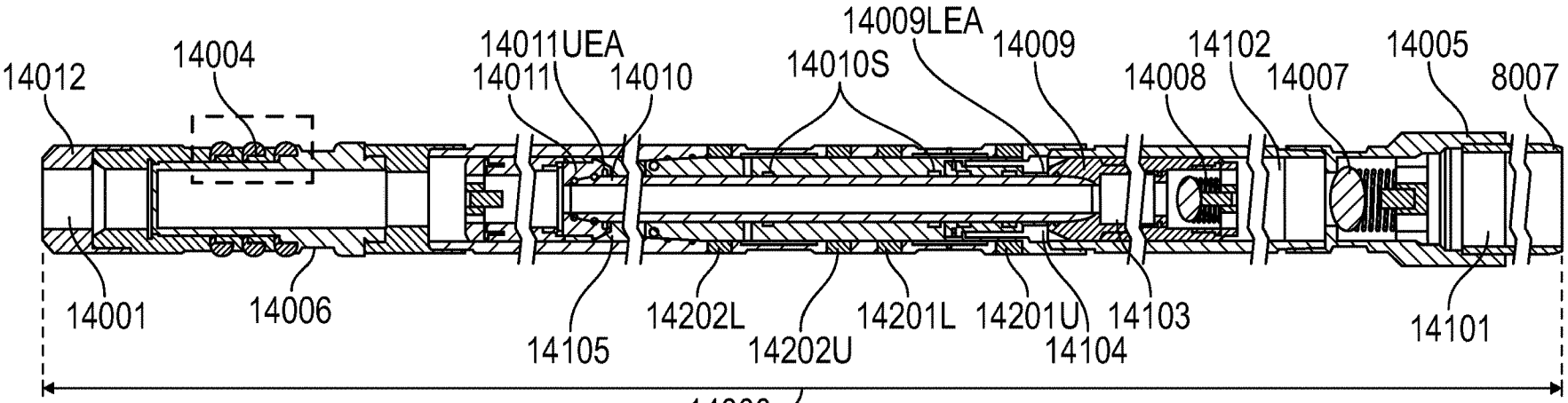
FIGS. 14DS and 14US illustrate a rodless pump that is threaded directly on the bottom of the production tubing in the downstroke and upstroke positions, respectively FIG. 14HS illustrates a hydraulic sub receptacle for a tubing retrievable pump run in an open annulus system.
Figure 14U:
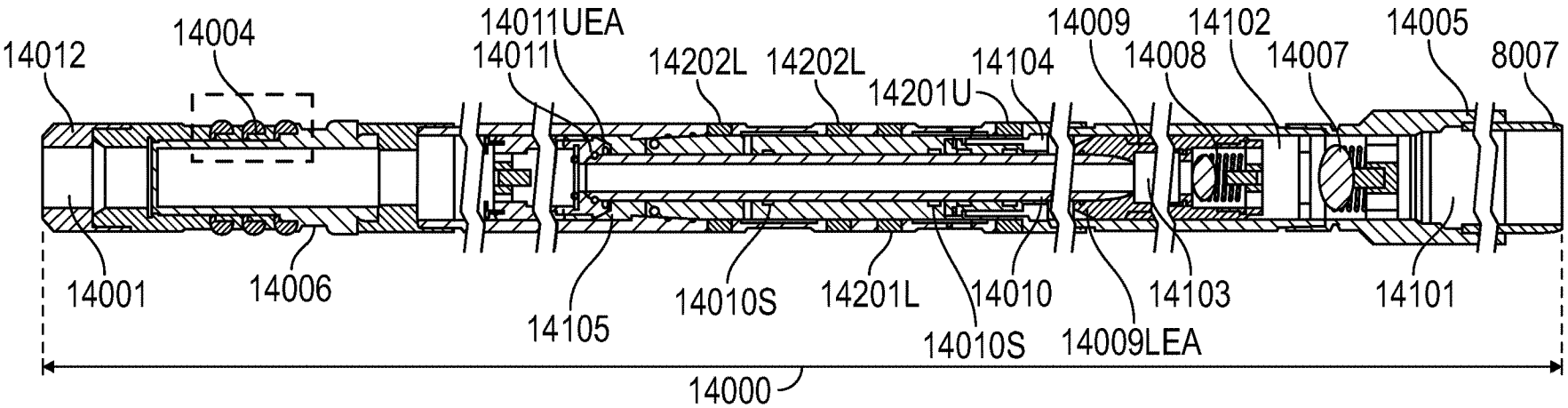

FIGS. 14DS and 14US illustrate an embodiment of rodless pump 14000 that is threaded directly on the bottom of the production tubing 8007. This embodiment is thus retrievable only by removing the tubing from the well. The tubing retrievable version of the pump is threaded into the production tubing string, and thus a rig is necessary to retrieve or lower it into the hole. The pump 14000 has a production tubing crossover sub 14005 that threads the pump assembly onto the production tubing string 8007. The tubing retrievable rodless pump 14000 may be the same for both closed and open annulus systems. The pump can include: production tubing crossover sub 14005, lower hold down sub 14006, hold down seals 14004, standing check valve 14007, traveling check valve 14008, upper working piston 14009, connecting rod 14010, and lower working piston 14011, bottom intake 14001, and bullnose 14012. The standing check valve and traveling check valves are illustrated as spring-loaded ball and seat arrangements, although other types of checks may be used such as a flapper, dart, or caged ball check valves. The traveling check valve is pictured in the upper working piston 14009, which minimizes non-stroked volume within the pump chamber. However, the traveling check may also be placed within the lower working piston or the connecting rod. In some embodiments, the standing valve may be located below the traveling valve. The upper working piston 14009 may be connected to the lower working piston 14011 by connecting rod 14010. The connecting rod 14010 may contact the connecting rod seals 14010S that may isolate the pressure between the upper power fluid chamber 14104 and lower power fluid chamber 14105. The connecting rod seals 14010S are pictured as O-ring type seals but may also be a metal-to-metal type seal. The production fluid chambers include the production lift chamber 14101, the pump chamber 14102, and the reservoir/wellbore fluid chamber 14103. The power fluid chambers include the upstroke power fluid chamber 14104 and the downstroke power fluid chamber 14105. The power fluid in the downstroke power fluid chamber 14105 exerts a force on the upper exposed area of the lower piston 14011UEA to actuate the pump down. The power fluid in the upstroke power fluid chamber 14104 exerts a force on the lower exposed area of the upper piston 14009LEA to actuate the pump up. The power fluid in the upstroke power fluid line 8004 is hydraulically in communication with the upstroke power fluid chamber 14104 via the hydraulic sub. The power fluid in the downstroke power fluid line 8005 is hydraulically in communication with the downstroke power fluid chamber 14105 via the hydraulic sub.

FIG. 14HS depicts the hydraulic sub receptacle 8006TO for a tubing retrievable pump 14000 run in an open annulus system. The hydraulic sub may be attached to the bottom of the outer power fluid tubing string 8005T. The uppermost part of the hydraulic sub 8006TO is the seal sub 14003SS, designed to mate with seals 14003ITS. The seals 14003ITS are disposed on the inner tubing seal carrier sub 14003ITSC, which is disposed on the bottom of the inner power fluid string 8004T. The annulus between the inner power fluid tubing 8004T and the outer power fluid string 8005T comprises the downstroke power fluid flow path 8005. Downstroke power fluid flow path 8005 and upstroke power fluid flow path 8004 may be separated by the contact seals between 14003SS and 14003 ITS. The power fluid seal sub 14003 may be above and threaded into the hydraulic landing sub extension 14002A, landing sub 14002, and lower piston housing 14003A. Because the seals isolating the lower power fluid chamber from the production fluids are located up hole of the lower piston housing 14003A, a standard tubing joint with a seal on the bottom may function as a lower piston housing and attach to the bottom of the hold down sub 14002. The tubing can include a landing sub 14002 that contacts the hold down seals on the pump 14004. The hydraulic fluid seal sub can also include specialized upper and lower recesses 14003U, 14003L to allow flow into the upper power fluid chamber 14104 and lower power fluid chambers 14105, respectively; the hydraulic power fluid seal sub also contains seal areas 14003LS, 14003MS, and 14003US that mate with the lower pump seals 14202L, middle pump seals 14202U and 14201L, and upper pump seals 14201U, respectively. This combination of upper and lower recesses surrounded by a seal arrangement that seals the area above the top recess 14003US, in between the two recesses 14003MS, isolating the flows between the two power fluid chambers, and below the bottom recess 14003LS, allow the power fluid conduits to actuate the pump in the upstroke and downstroke directions without materially mixing power fluid and production fluid.

Figure 14:
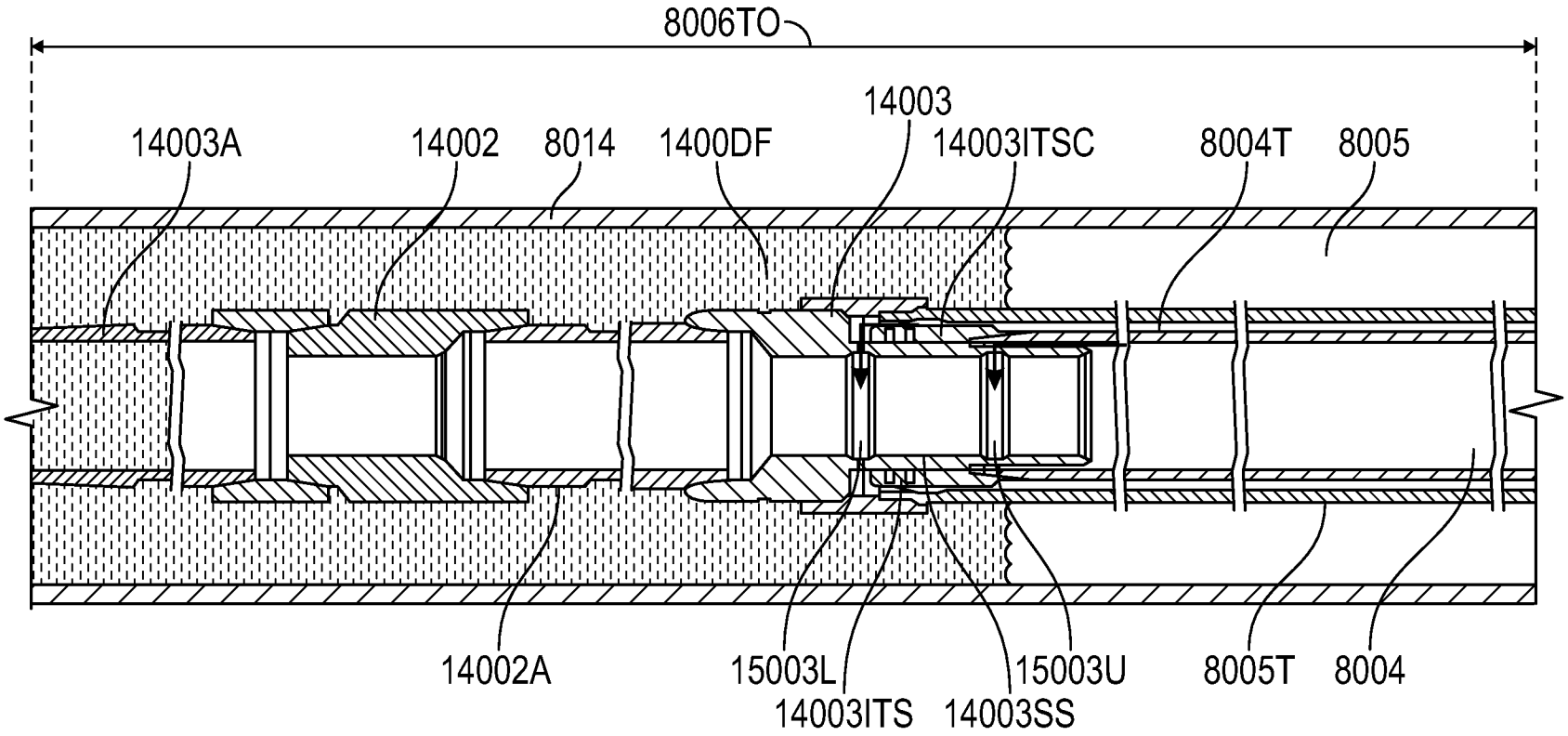
FIG. 14 illustrates a tubing retrievable rodless pump landed inside an open annulus hydraulic sub.
Figure 14:
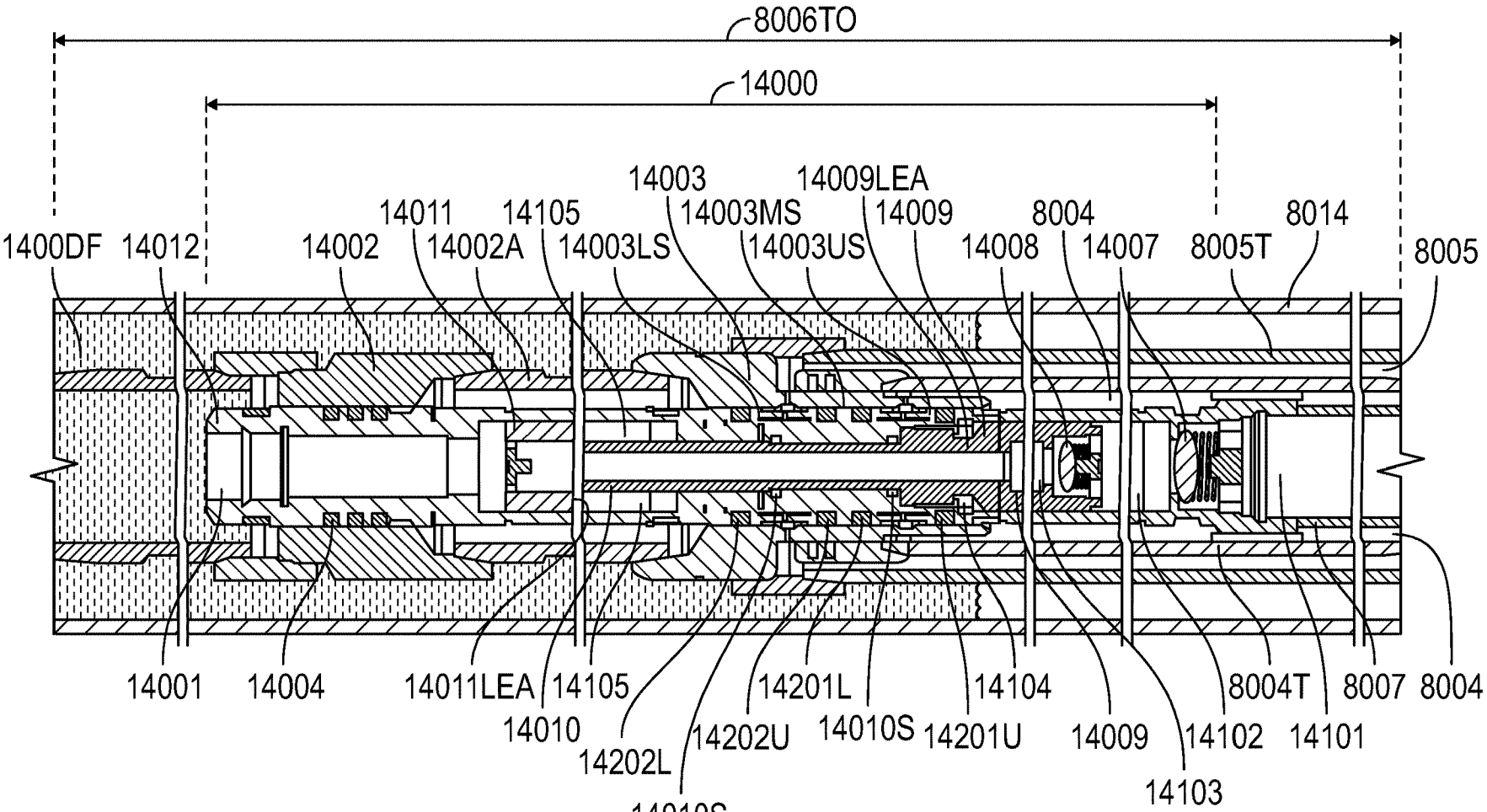

FIG. 14 illustrates a detailed view of a tubing retrievable rodless pump 14000 landed inside an open annulus hydraulic sub 8006TO. The hydraulic sub 8006TO may be disposed on the end of the outer tubing string 8005T that acts as a barrier between the concentric power fluid pathway 8005 and the well's open annulus containing downhole fluid 14000DF. The outer power fluid string 8005T and hydraulic sub 8006TO may be lowered into the well first. The inner power fluid string 8004T may then run inside of 8005T and be landed on the upward facing seal area of seal sub 14003SS. The annulus between outer power fluid string 8005T and the inner power fluid string 8004T can include the downstroke power fluid conduit 8005 that may be hydraulically connected to the downstroke power fluid chamber 14105. The annulus between inner power fluid string 8004T and the production tubing 8007 can include the upstroke power fluid conduit 8004 that may be hydraulically connected to the upstroke power fluid chamber 14104. Tubing retrievable pump 14000 may be landed in the hydraulic sub 8006TO that may be connected independently to both the upstroke power fluid conduit 8004 and the downstroke power fluid conduit 8005. A lower hold down sub 14002 is illustrated below the lower piston 14009 of the pump, but a similar upper landing sub above the upper pump piston 14011 could be used for a top hold down. The hydraulic sub can include hydraulic power fluid seal sub 14003. The hydraulic power fluid seal sub and landing sub may be used to hold the rodless pump in the wellbore and transfer the power fluid from the power fluid lines to and from the pump with minimal mixing of power fluid and production fluid. When the pump 14000 is landed in the hydraulic sub 8006TO, seals above and below both power fluid chambers 14104 and 14105 may be engaged by the power fluid seal sub 14003 and may force the fluid from the upstroke conduit 8004 through the upper recess 14003U and into the upstroke chamber 14104 and fluid from the downstroke conduit 8005 through the lower recess 14003L into the downstroke chamber 14105. The upstroke fluid chamber seals are 14201U and 14201L, and the downstroke chamber seals are 14202U and 14202L. Seals 14201L and 14202U may be combined into a single seal in some embodiments. This seal arrangement may contact the areas 14003LS, 14003MS, and 14003US to force upstroke power fluid from 8004 in between seal areas 14003MS and 14003US into the upstroke power fluid chamber 14104 and to force downstroke power fluid from 8005 in between seal areas 14003MS and 14003LS into the downstroke power fluid chamber 14105.

FIGS. 14A, 14B, 14C, and 14D depict the fluid flow through a rodless pump 14000 landed in an open annulus hydraulic sub 8006TO with concentric power fluid flow paths 8004 and 8005 and inner power fluid tubing 8004T and outer power fluid tubing 8005T. Arrows in FIGS. 14A, 14B, 14C, and 14D in the upstroke and downstroke lines show the direction of power fluid and production fluid during the upstroke and downstroke. On the downstroke, fluid is flowing into the pump through the downstroke line and out of the pump, towards surface, in the upstroke line. On the upstroke, power fluid is flowing into the pump through the upstroke line and out of the pump, towards surface, in the downstroke line.

Figure 14A:
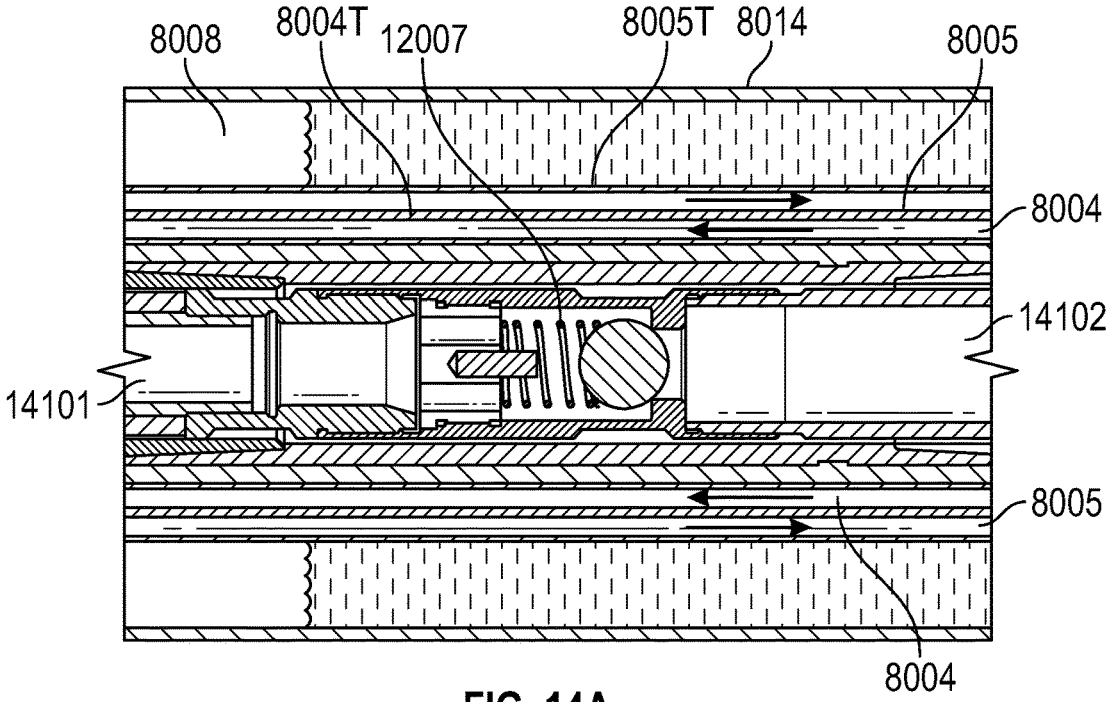
Figure 14B:
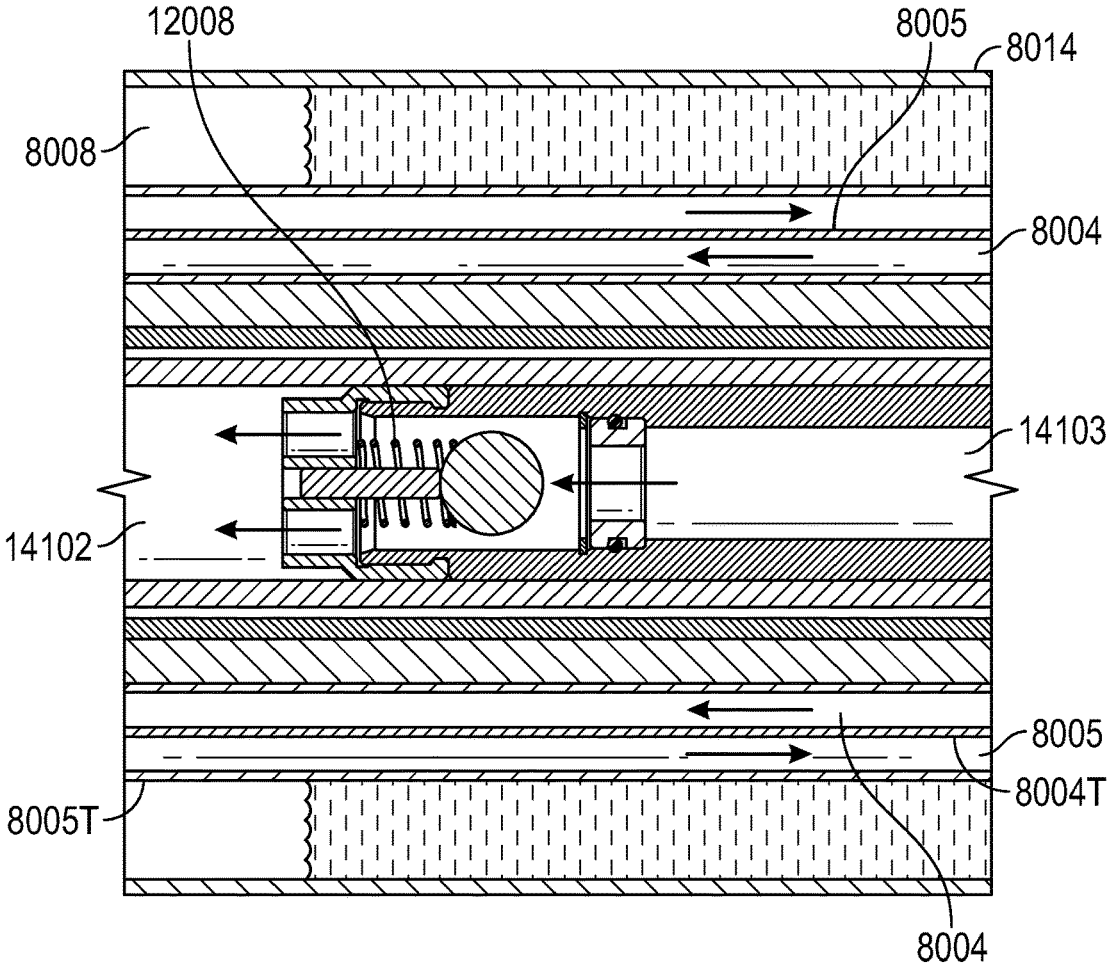

FIG. 14A depicts the standing check valve 14007 in the closed position on the downstroke. FIG. 14B depicts the traveling check valve in the downstroke, unseated position allowing fluid to pass. During the downstroke, the standing check valve 14007 may be seated, and the traveling check 14008 may be unseated, allowing fluid to pass to the pump chamber 14102. For the bottom intake pump, wellbore fluid may enter into the rodless pump from the bottom production fluid intake 14001 and may travel into the lower piston 14011 and then into the hollow connecting rod 14010. From the connecting rod fluid may travel into the upper working piston 14009, which can include the unseated traveling check valve 14008. Fluid may then enter the pump chamber 14102 on the downstroke.

Figure 14C:
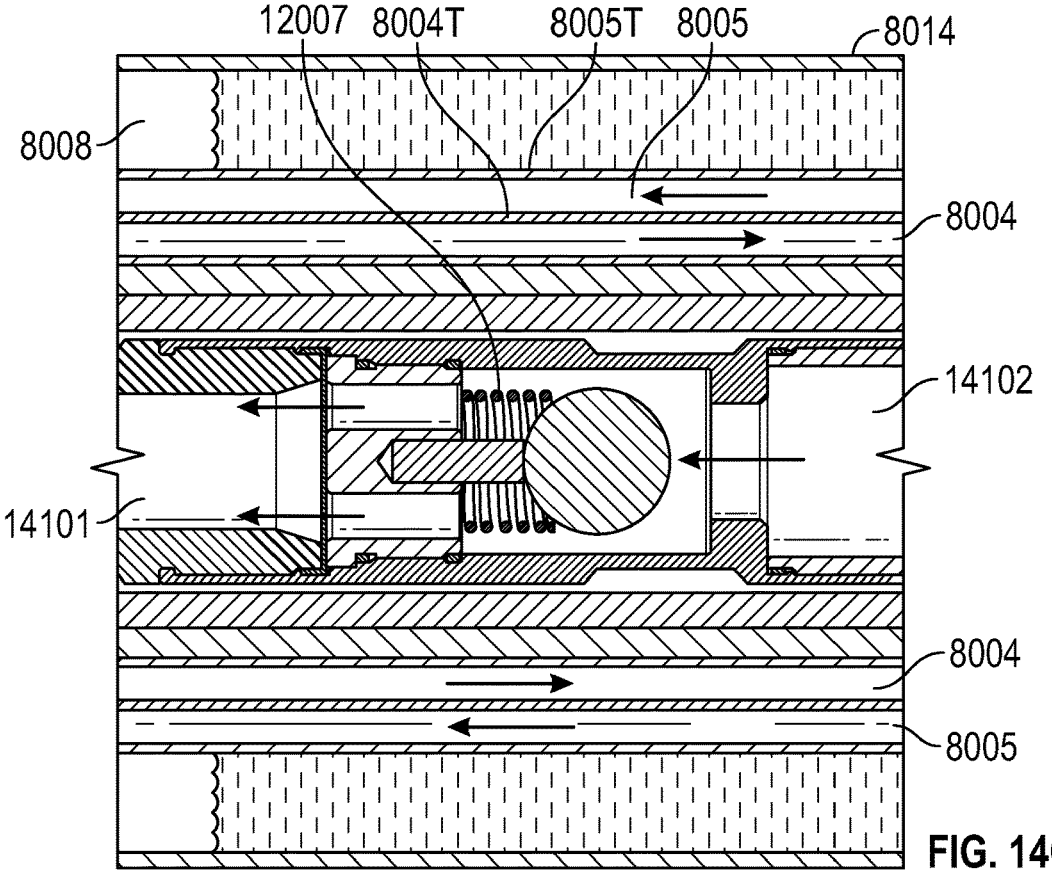
Figure 14D:
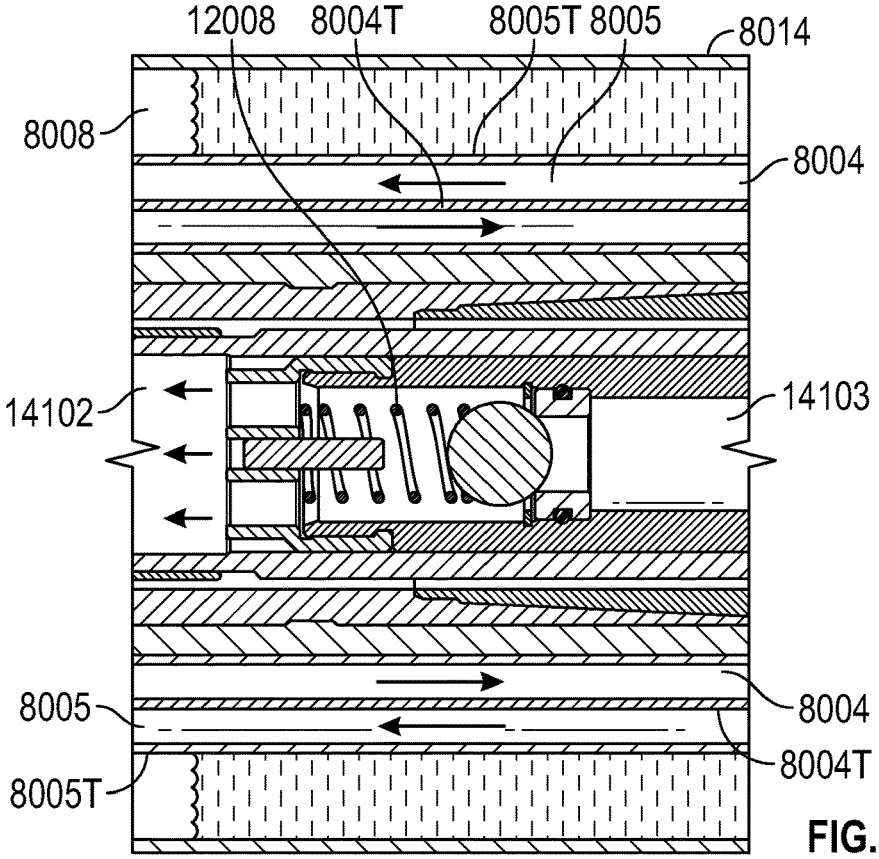

FIG. 14C depicts the standing check valve 14007 in the upstroke, unseated position allowing fluid to pass. FIG. 14D depicts the traveling check valve 14008 in the closed position on the upstroke. On the upstroke, the traveling check valve 14008 may seat from the hydrostatic pressure acting on it in the production tubing and pump chamber. The pressure in the pump chamber may increase until the pressure exceeds the pressure in the production tubing above the standing valve 14007, and the ball is moved off the seat of the standing valve as fluids flow to surface.

Figure 15:
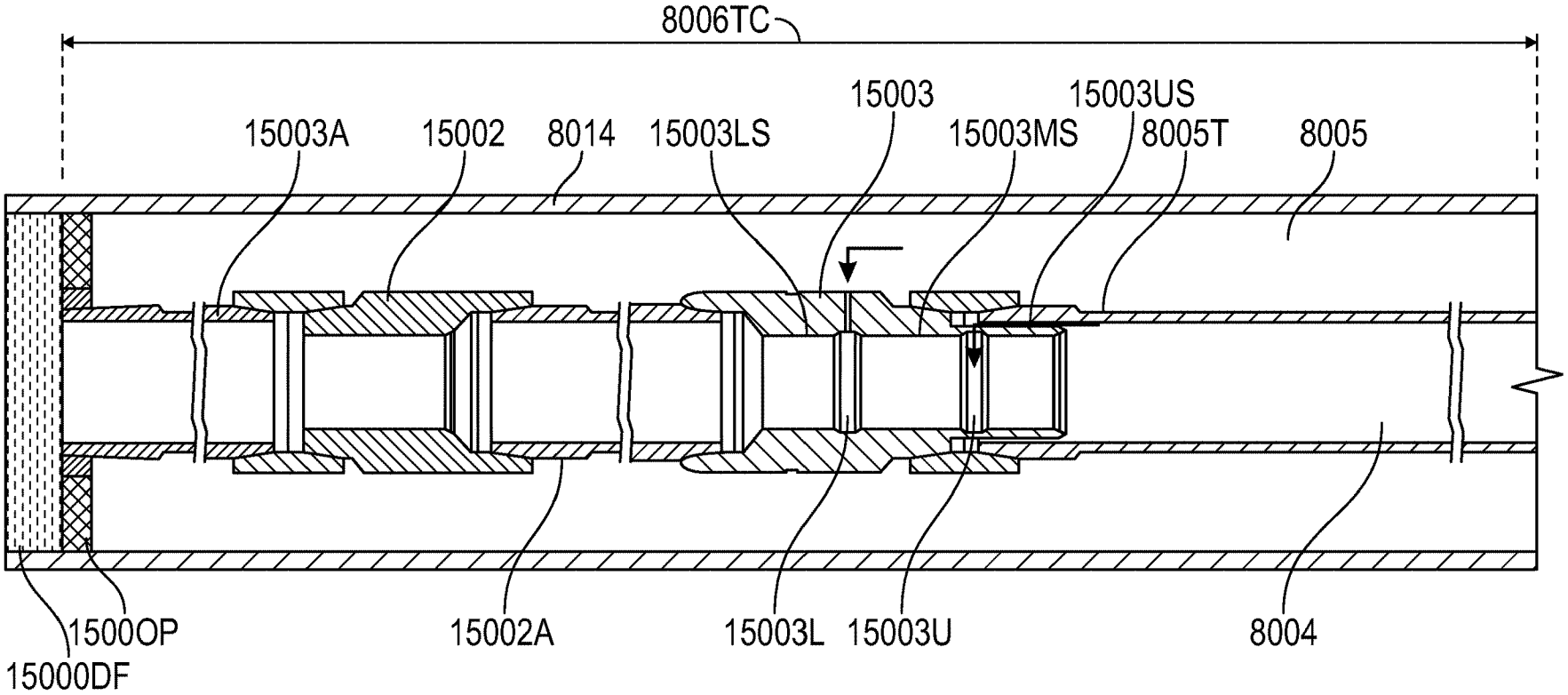
FIG. 15 illustrates a tubing retrievable rodless pump landed inside a closed annulus hydraulic sub.
Figure 15:
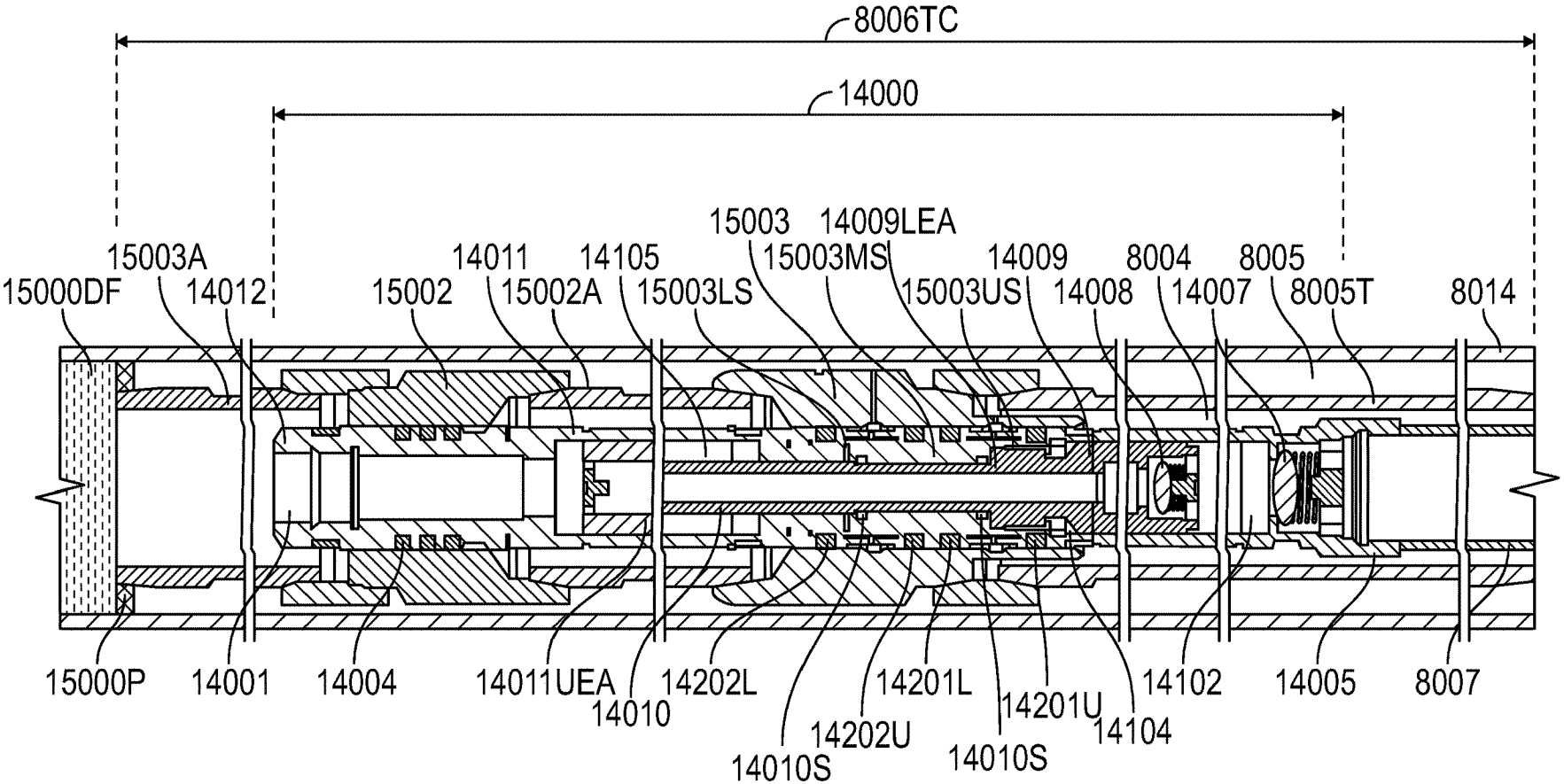

FIG. 15HS depicts the hydraulic sub receptacle 8006TC for a tubing retrievable pump 14000 run in a closed annulus system run above a packer 15000P that seals against the casing 8014 to isolate the downhole fluids (oil, gas, and water) 15000DF below. The packer 15000P can include an inner seal bore that the bottom of the hydraulic sub 8006TC may be inserted into. The hydraulic sub may be attached to the bottom of the power fluid tubing string 8005T. The uppermost part of the hydraulic sub can include the power fluid seal sub 15003, hydraulic landing sub extension 15002A, landing sub 15002, and lower piston housing 15003A. Because the seals isolating the lower power fluid chamber from the production fluids are located up hole of the lower piston housing 15003A, a standard tubing joint with a seal on the bottom may function as a lower piston housing and attach to the bottom of the hold down sub 15002. The tubing retrievable pump can include a hold down sub 15002 that contacts the hold down seals on the pump 14004. The hydraulic fluid seal sub can include upper and lower recesses 15003U, 15003L to allow flow into the upper power fluid chamber 14104 and lower power fluid chambers 14105, respectively. The hydraulic power fluid seal sub can also include seal areas 15003LS, 15003MS, and 15003US that mate with the lower pump seals 14202L, middle pump seals 14202U and 14201L, and upper pump seals 14201U, respectively. This combination of upper and lower recesses surrounded by a seal arrangement that seals the area above the top recess 15003US, area in between the two recesses 15003MS, isolating the flows between the two power fluid chambers, and area below the bottom recess 15003LS, allow the power fluid conduits to actuate the pump in the upstroke and downstroke directions without materially mixing power fluid and production fluid FIG. 15 illustrates a tubing retrievable rodless pump 14000 landed inside a closed annulus hydraulic sub 8006TC. The hydraulic sub may be disposed on the end of the outer tubing string 8005T that acts as a barrier between the concentric power fluid paths 8004 and 8005. The outer tubing string 8005T with attached hydraulic sub 8006TC may be lowered first into the well. The production string

8007 with the tubing retrievable rodless pump 14000 may then run inside the outer tubing string 8005T and landed in the hydraulic sub 8006TC. The outermost annulus can include the downstroke power fluid conduit 8005 contained by the production casing 8014. The bottom seal on the hydraulic sub 8006TC may be inserted into a packer 14000P that seals against the casing, with production fluids 15000DF below the packer. The pump may be landed in the hydraulic sub 8006TC that may be connected independently to both the upstroke power fluid conduit 8004 and the downstroke power fluid conduit 8005. A lower hold down sub 15002 is pictured below the lower working piston 14009 of the pump, but a similar upper landing sub above the upper working piston 14011 could be used for a top hold down. The hydraulic sub can include hydraulic power fluid seal sub 15003. The hydraulic power fluid seal sub and landing sub may be used to hold the rodless pump in the wellbore and transfer the power fluid from the power fluid lines to and from the pump with minimal mixing of power fluid and production fluid. When the pump 14000 is landed in the hydraulic sub 8006TC, seals above and below both power fluid chambers 14104 and 14105 may be engaged by the power fluid seal sub 15003 and may force the fluid from the upstroke conduit 8004 through the upper recess 15003U and into the upstroke chamber 14104 and fluid from the downstroke conduit 8005 through the lower recess 15003L into the downstroke chamber 14105. The upstroke fluid chamber seals are 14201U and 14201L, and the downstroke chamber seals are 14202U and 14202L. Seals 14201L and 14202U may be combined into a single seal in some embodiments. This seal arrangement contacts the areas 15003LS, 15003MS, and 15003US to force upstroke power fluid from 8004 in between seal areas 15003MS and 15003US into the upstroke power fluid chamber 14104 and downstroke power fluid from 8005 in between seal areas 15003MS and 15003LS into the downstroke power fluid chamber 14105.

FIGS. 15A, 15B, 15C, and 15D depict the fluid flow through a rodless pump 14000 landed in a closed annulus hydraulic sub 8006TC with concentric power fluid paths 8004 and 8005 and power fluid tubing string 8005T. Arrows in FIGS. 15A, 15B, 15C, and 15D in the upstroke and downstroke lines show the direction of power fluid and production fluid during the upstroke and downstroke. On the downstroke, fluid is flowing into the pump through the downstroke line and out of the pump, towards surface, in the upstroke line. On the upstroke, power fluid is flowing into the pump through the upstroke line and out of the pump, towards surface, in the downstroke line.

Figure 15A:
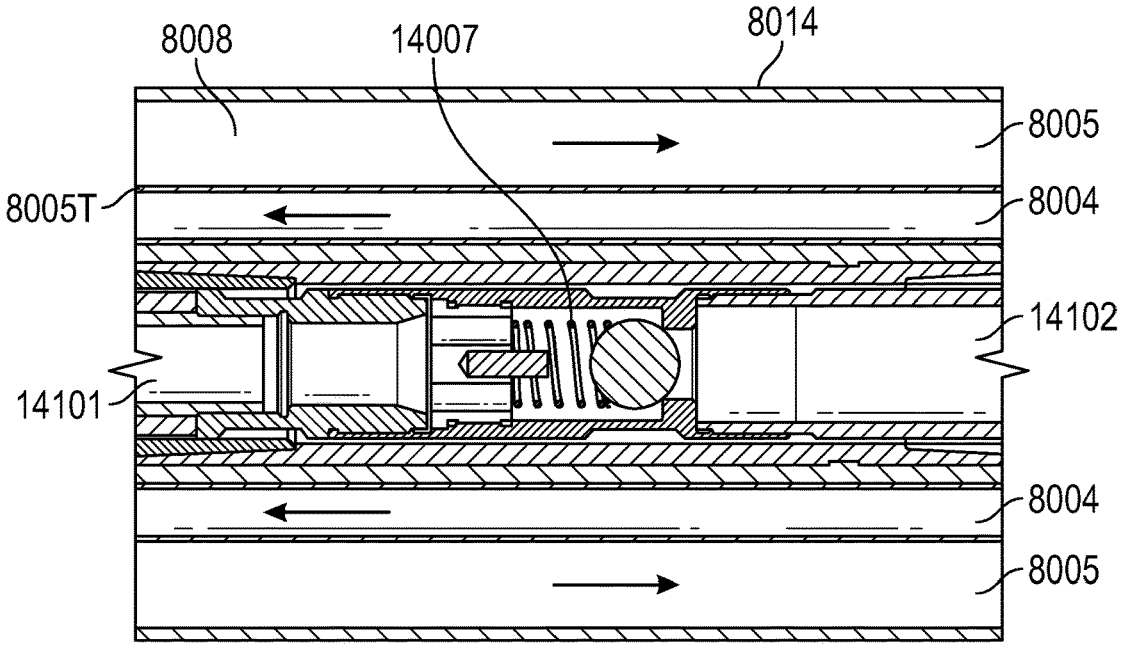
FIGS. 15A-15D depict the fluid flow through a rodless pump landed in a closed annulus hydraulic sub.
Figure 15B:
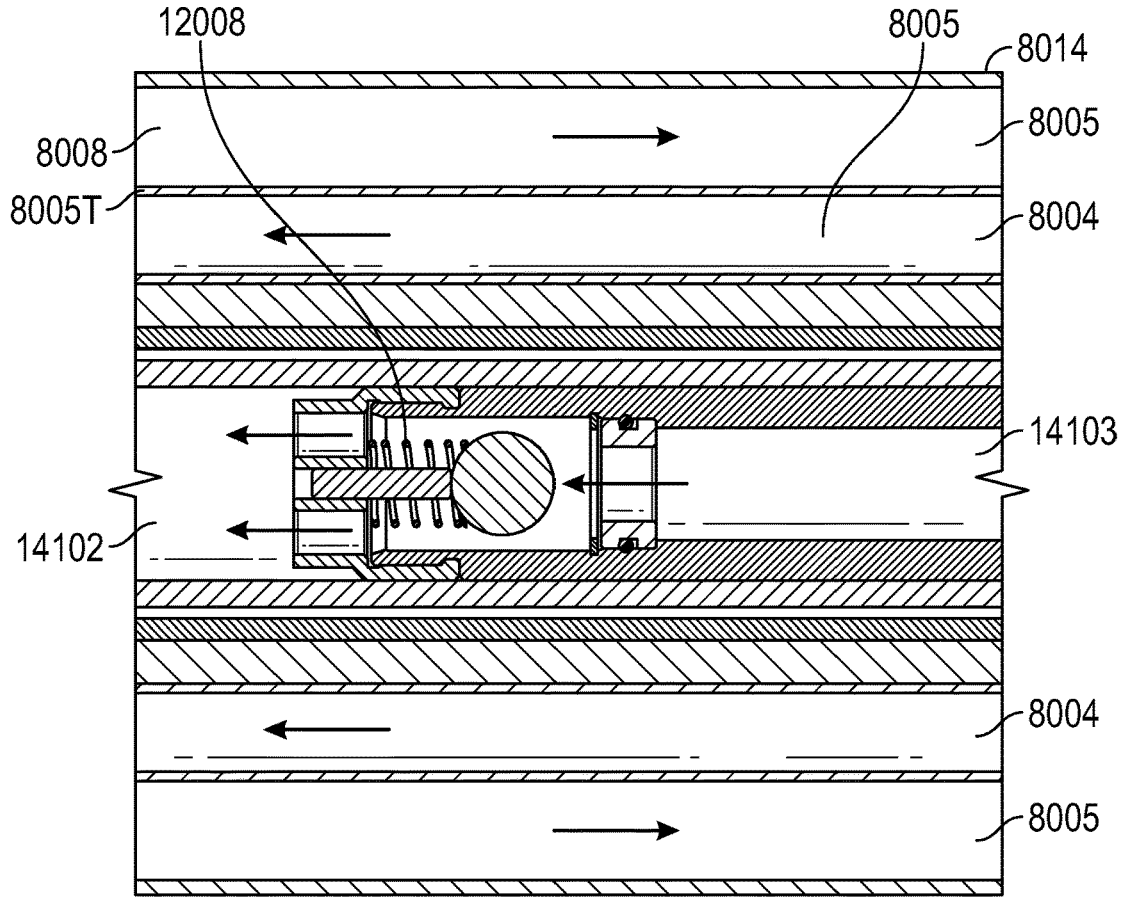

FIG. 15A depicts the standing check valve 14007 in the closed position on the downstroke. FIG. 15B depicts the traveling check valve in the downstroke, unseated position allowing fluid to pass. During the downstroke, the standing check valve 14007 may be seated, and the traveling check 14008 may be unseated, allowing fluid to pass to the pump chamber 14102. For the bottom intake pump, wellbore fluid may enter into the rodless pump from the bottom production fluid intake 14001 and may travel into the lower working piston 14011 and then into the hollow connecting rod 14010). From the connecting rod fluid may travel into the upper working piston 14009, which includes the unseated traveling check valve 14008. Fluid may then enters the pump chamber 14102 on the downstroke.

Figure 15C:
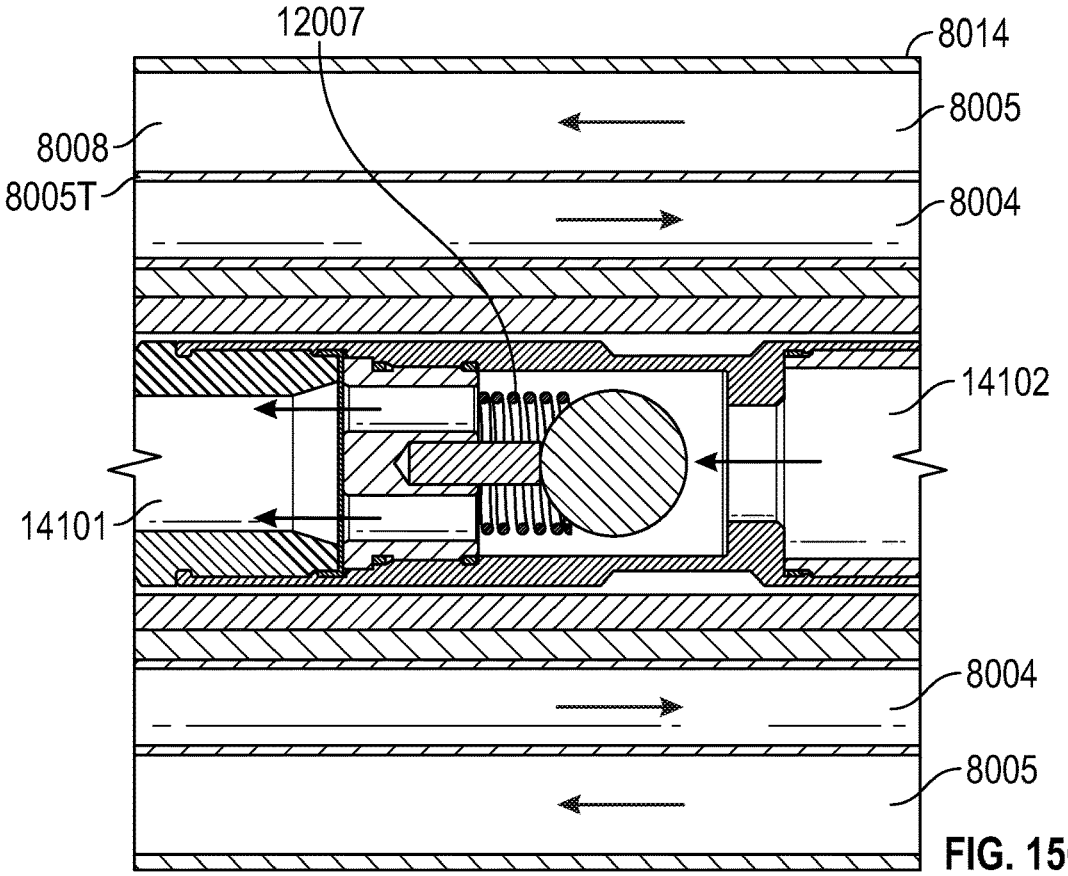
Figure 15D:
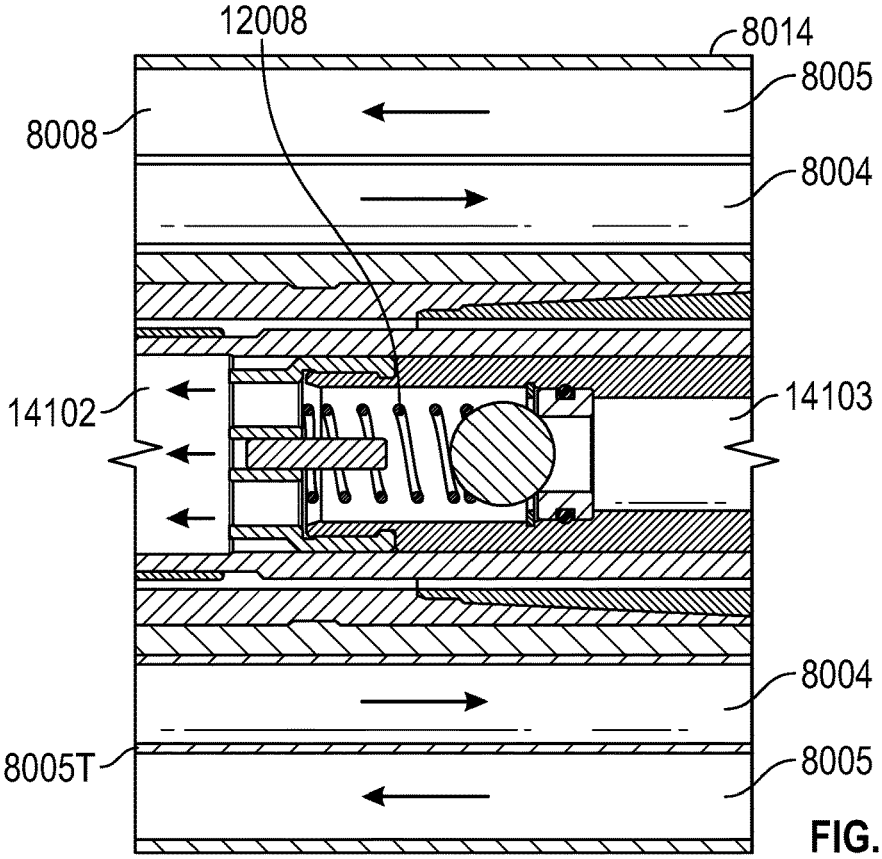

FIG. 15C depicts the standing check valve 14007 in the upstroke, unseated position allowing fluid to pass. FIG. 15D depicts the traveling check valve 14008 in the closed position on the upstroke. On the upstroke, the traveling check 14008 may seat from the hydrostatic pressure acting on it in the production tubing and pump chamber. The pressure in the pump chamber may increase until the pressure exceeds the pressure in the production tubing above the standing valve 14007, and the ball is moved off the seat of the standing valve as fluids flow to surface.

Seals 12201U, 12202L, 12202U, 12202L, 14201U, 14201L, 14202U, and 14202L may take the form of chevron of vee packing seals that can be arranged to provide a bidirectional or unidirectional seal, and may be energized by radial compression between seal carrier and the hydraulic sub. Although there are advantages associated with the chevron seal design, they may require a substantial force to engage when used in a static energizing design (as currently depicted). It is possible to replace the chevron seal with one or more other seal designs, such as an O-ring or multiple O-rings, as well as other seal cross-sections that perform in a similar manner. Additionally, a bonded seal arrangement could be implemented to reduce leak paths through a chevron seal design and potentially improve the reliability of the seal over time. The bonded seal arrangement could take the form of being bonded directly to the seal carrier, or bonded to a small ring of material that is then placed in the assembly. In the latter implementation another seal (such as an O-ring) would typically be used to seal the ring of material to seal carrier. Furthermore, a bonded seal arrangement could be configured where the seal is combined with another component such as the seal spacer or bottom landing sub. Another implementation would be a lip seal arrangement that is energized by the hydraulic pressure applied by the primary power source. One potential advantage of such an arrangement is lower insertion pressure, which eases landing of the pump and also protects the seal during landing.

FIGS. 16A-F illustrate a simplified visualization of a full cycle of a rodless pump with an open annulus hydraulic sub from downstroke to upstroke back to downstroke. Certain features of the pump are represented in simplified manner for viewing clarity to show an improved picture of the power fluid and production fluid, including production hydrocarbons, flows simultaneously. Previously described standing valve 12007 (shown as a flapper check instead of a ball and spring check), traveling valve 12008 (shown as a ball sitting on the top of the upper piston), upper working piston 12009, piston rod 12010, lower working piston 12011, wellbore fluid chamber 12103, pump chamber 12102, and produced fluid chamber 12101 are depicted. The upstroke power fluid line 8004, downstroke power fluid line 8005, upstroke power fluid chamber 12104, and downstroke power fluid chambers 12105 are also shown. The seal detail between the pump and tubing are simplified in this illustration.

Figure 16F:
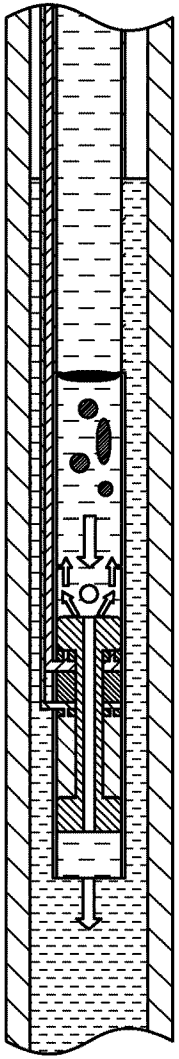
FIGS. 16A-F illustrate a simplified visualization of a full cycle of a rodless pump with an open annulus hydraulic sub.
Figure 16E:
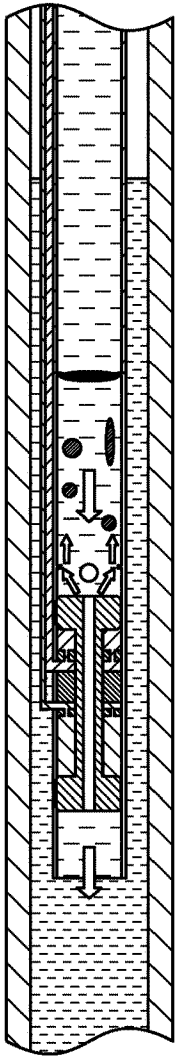
Figure 16D:
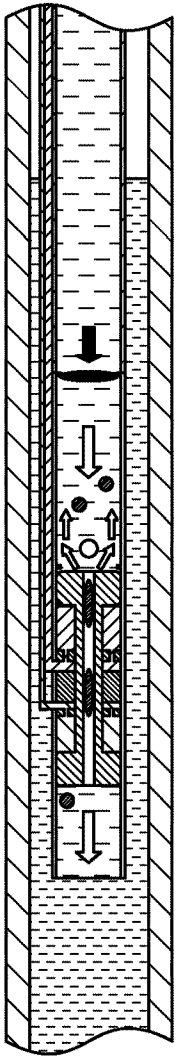
Figure 16C:
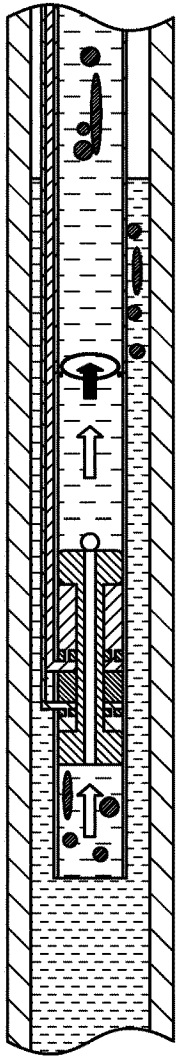
Figure 16B:
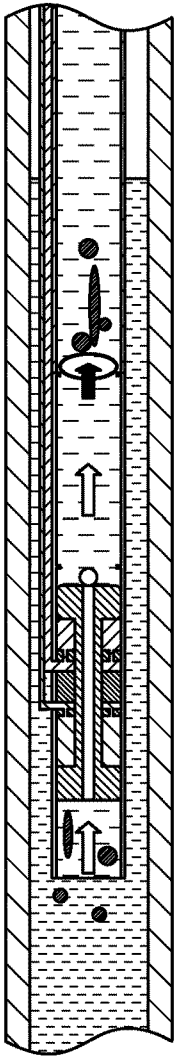
Figure 16A:
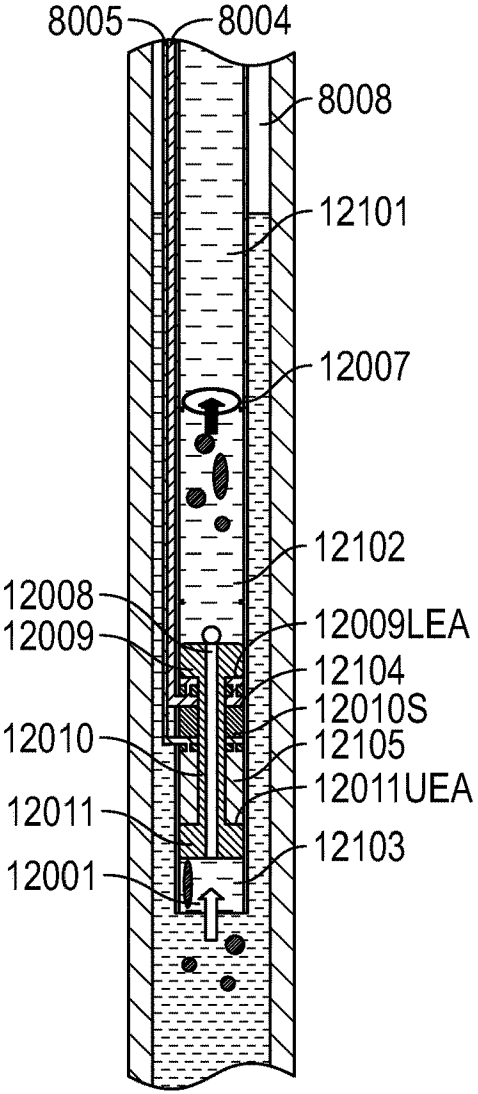

In FIG. 16A, the working pistons sit near the bottom position as the upstroke starts. The upstroke power fluid pressure increases and power fluid flows into the upstroke power fluid chamber, while the down stroke power fluid flows back up the downstroke power fluid line. The traveling valve seats, and the standing valve opens to the tubing, allowing fluid (oil, gas, and water) to flow through.

In FIG. 16B, the pump at surface continues to apply pressure to the upstroke power fluid, overcoming the force of the hydrostatic pushing against the top surface of the top piston. The pistons move upward in reaction to the force applied to the exposed area on the bottom of the upper working piston, pressurizing the pump chamber and pushing fluid to surface.

In FIG. 16C, the working pistons have almost reached the top of the stroke as upstroke power fluid continues to fill the upstroke power fluid chamber. The wellbore fluid flows into the wellbore fluid chamber below the bottom working piston of the pump.

In FIG. 16D, the surface pump switches from applying pressure to the upstroke power fluid to the downstroke power fluid, forcing the pistons down as the downstroke chamber gains fluid volume. A vacuum is created in the pump chamber and the ball sitting on top of the traveling valve comes off seat, drawing more fluid into the pump chamber and closing the top check valve.

In FIG. 16E, the pistons continue down with the standing valve check closed, bringing upstroke power fluid back to surface and bringing more wellbore fluid into the production fluid chamber.

In FIG. 16F, the working pistons have reached the bottom of the downstroke. The pump stops applying pressure to the downstroke power fluid and switches back over to the upstroke power fluid to restart the upstroke cycle.

FIGS. 17A-F shows a simplified visualization of a full cycle of a rodless pump with a closed annulus hydraulic sub from downstroke to upstroke back to downstroke. Certain features of the pump are represented in simplified manner for viewing clarity to show an improved picture of the power fluid and production fluid, including production hydrocarbons 13000DF, flows simultaneously. Previously described standing valve 12007 (shown as a flapper check instead of a ball and spring check), upper working piston 12009, piston rod 12010, lower working piston 12011, pump chamber 12102, produced fluid chamber 12101, packer 13000P, and casing 8014 are depicted. The upstroke power fluid line 8004, downstroke power fluid line 8005, upstroke power fluid chamber 12104, and downstroke power fluid chambers 12105 are also shown. The seal detail between the pump and tubing are simplified in this visualization.

Figure 17F:
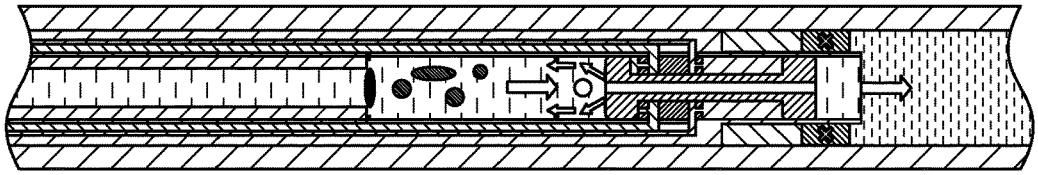
FIGS. 17A-F illustrate a simplified visualization of a full cycle of a rodless pump with a closed annulus hydraulic sub.
Figure 17E:
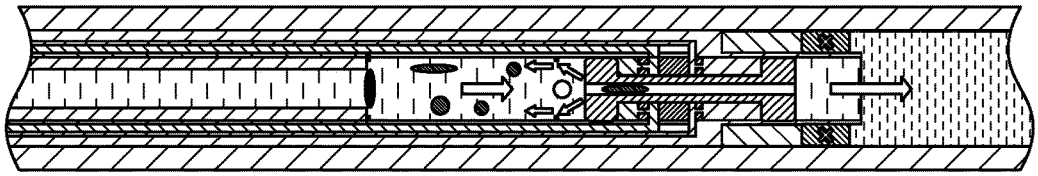
Figure 17D:
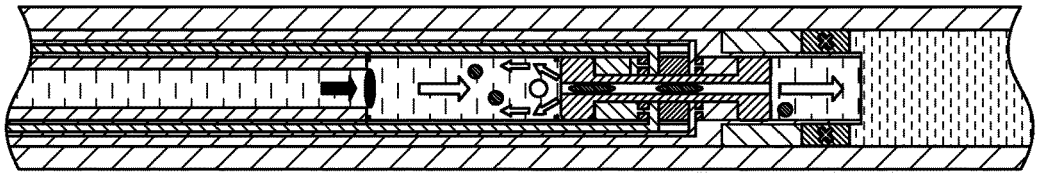
Figure 17C:
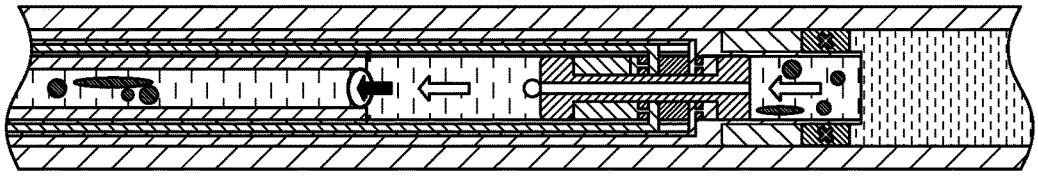
Figure 17B:
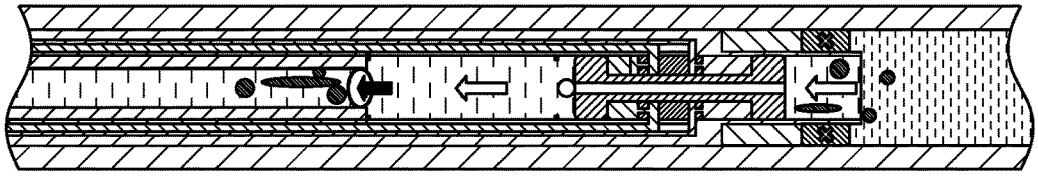
Figure 17A:
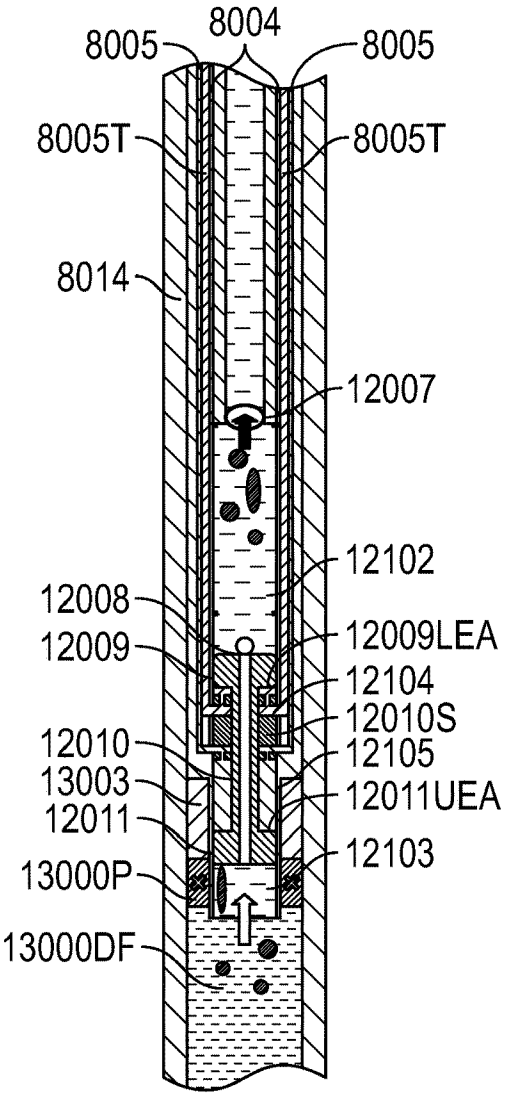

In FIG. 17A, the pistons sit near the bottom at of the stroke as the pump starts the upstroke. The upstroke power fluid pressure increases and power fluid flows into the upstroke power fluid chamber, while the down stroke power fluid flows back up the downstroke power fluid line. The traveling valve seats, and the standing valve opens to the tubing, allowing wellbore fluid (oil, gas, and water) to flow through.

In FIG. 17B, the pump at surface continues to apply pressure to the upstroke power fluid, overcoming the force of the hydrostatic pushing against the top surface of the top piston; the pistons move upward in response to the force acting on the lower exposed area of the upper working piston, pressurizing the pump chamber and pushing fluid to surface.

In FIG. 17C, the pistons have almost reached the top of the stroke as upstroke power fluid continues to fill the upstroke power chamber.

In FIG. 17D, the surface pump switches from applying pressure to the upstroke power fluid to the downstroke power fluid, forcing the pistons down as the downstroke chamber gains fluid volume. A vacuum is created in the pump chamber and the ball sitting in the traveling check valve comes off seat, drawing more fluid into the pump chamber and closing the standing check valve.

In FIG. 17E, the working pistons continues down with the standing valve check closed, bringing upstroke power fluid back to surface and bringing more wellbore fluid into the pump fluid chamber.

In FIG. 17F, the working pistons have reached the bottom of the downstroke. The pump stops applying pressure to the downstroke power fluid and switches back over to the upstroke power fluid to restart the upstroke cycle. The foregoing describes exemplary embodiments of a rodless downhole hydraulic pump. Although numerous specific features and various embodiments have been described, it is to be understood that, unless otherwise noted as being mutually exclusive, the various features and embodiments may be combined various permutations in a particular implementation. Thus, the various embodiments described above are provided by way of illustration only and should not be constructed to limit the scope of the disclosure. Various modifications and changes can be made to the principles and embodiments herein without departing from the scope of the disclosure and without departing from the scope of the claims.

The invention claimed is:

1. A downhole hydraulic pump comprising:

a first working piston having a first surface in contact with a power fluid and a second surface in contact with a wellbore fluid;

a second working piston having a first surface in contact with a power fluid and a second surface in contact with a wellbore fluid;

a connecting rod coupling the first working piston to the second piston;

a first working chamber defined at least in part by the first surface of the first working piston;

a second working chamber defined at least in part by the first surface of the second working piston;

a seal arrangement respectively coupling a first hydraulic line from the surface to the first working chamber and a second hydraulic line from the surface to the second working chamber, wherein pressure applied via at least one of the first hydraulic line and the second hydraulic line causes reciprocation of the working pistons; and a flow path comprising one or more check valves wherein the one or more check valves are actuated by fluid pressure changes caused by reciprocation of the working pistons, thereby permitting wellbore fluid to be pumped to the surface;

wherein at least one of the first and second hydraulic lines is concentric with and exterior to a production string.

2. The downhole hydraulic pump of claim 1 wherein the flow path is disposed within the connecting rod.

3. The downhole hydraulic pump of claim 1 wherein pressure is alternately applied via the first hydraulic line and the second hydraulic line to cause reciprocation of the working pistons.

4. The downhole hydraulic pump of claim 1 wherein the seal arrangement is a hydraulic sub.

5. The downhole hydraulic pump of claim 1 wherein the first working chamber and second chamber are pressure isolated from one another by seals disposed about the connecting rod.

6. The downhole hydraulic pump of claim 1 further comprising an external structure allowing surface equipment to latch onto and retrieve the pump without removing a production fluid string or the first and second hydraulic lines from a well.

7. The downhole hydraulic pump of claim 6 wherein the external structure is a fishing neck.

8. The downhole hydraulic pump of claim 1 wherein the pump is mechanically affixed to the production tubing such that retrieving the pump requires removing at least a portion of a production fluid string from a well.

9. The downhole hydraulic pump of claim 8 wherein retrieving the pump further requires removing at least a portion of one or both of the first and second hydraulic lines from the well.

10. The downhole hydraulic pump of claim 1 wherein at least one of the first hydraulic line, second hydraulic line, and the production tubing is non-coaxial with respect to the others.

11. The downhole hydraulic pump of claim 1 wherein both the first and second hydraulic lines are concentric with and exterior to the production string.

12. The downhole hydraulic pump of claim 1 wherein one of the first or second hydraulic lines is defined at least in part by a casing of the well.

13. The downhole hydraulic pump of claim 12 wherein at least one of the first hydraulic line, second hydraulic line, and the production tubing is non-coaxial with respect to the others.

14. The downhole hydraulic pump of claim 12 wherein both the first and second hydraulic lines are concentric with and exterior to the production string.

15. A method of pumping fluid from a wellbore, the method comprising:

delivering working fluid via a first hydraulic line from the surface to a first working chamber of a downhole hydraulic pump, the first working chamber being defined at least in part by a first working piston, thereby actuating a piston assembly of the pump comprising the first working piston in a first direction; and delivering working fluid via a second hydraulic line from the surface to a second working chamber of the downhole hydraulic pump, the second working chamber being defined at least in part by a second working piston, thereby actuating the piston assembly of the pump, which further comprises the second working piston, in a second direction opposite the first direction, wherein the piston assembly further comprises a connecting rod coupling the first working piston and the second working piston;

wherein reciprocation of the piston assembly actuates one or more check valves, thereby permitting wellbore fluid to be pumped to the surface, and wherein at least one of the first and second hydraulic lines is concentric with and exterior to a production string.

16. The method of claim 15 wherein wellbore fluid is pumped to the surface through a flow path disposed within the connecting rod.

17. The method of claim 15 further comprising alternately:

delivering working fluid to the first working chamber via the first hydraulic line from the surface; and delivering working fluid to the second working chamber via the second hydraulic line from the surface.

18. The method of claim 15 wherein the first working chamber and second working chamber are pressure isolated from one another by seals disposed about the connecting rod.

19. A downhole hydraulic pump comprising:

a piston assembly comprising first and second pistons coupled by a connecting rod, wherein the first piston at least partially defines a first working chamber and the second piston at least partially defines a second working chamber;

means for causing reciprocal action of the piston assembly by alternating application of hydraulic fluid pressure via first and second hydraulic lines from the surface to the first and second working chambers, wherein at least one of the first and second hydraulic lines is concentric with and exterior to a production string;

a production fluid flow path that passes through the piston assembly and further comprises at least one check valve actuatable by wellbore fluid pressure changes induced by reciprocation of the piston assembly.

* * * * *